US010513114B2

(12) United States Patent
Arakane

(10) Patent No.: US 10,513,114 B2
(45) Date of Patent: Dec. 24, 2019

(54) INK-JET PRINTER

(71) Applicant: Brother Kogyo Kabushiki Kaisha, Nagoya-shi, Aichi-ken (JP)

(72) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/048,453

(22) Filed: Jul. 30, 2018

(65) Prior Publication Data

US 2019/0061345 A1 Feb. 28, 2019

(30) Foreign Application Priority Data

Aug. 29, 2017 (JP) ..... 2017-163862

(51) Int. Cl.
*B41J 2/045* (2006.01)
*B41J 2/165* (2006.01)

(52) U.S. Cl.
CPC ..... *B41J 2/04571* (2013.01); *B41J 2/0454* (2013.01); *B41J 2/04536* (2013.01); *B41J 2/04551* (2013.01); *B41J 2/04553* (2013.01); *B41J 2/04581* (2013.01); *B41J 2/04586* (2013.01); *B41J 2/04588* (2013.01); *B41J 2/04591* (2013.01); *B41J 2/04593* (2013.01); *B41J 2/16517* (2013.01); *B41J 2/16526* (2013.01); *B41J 2/04596* (2013.01)

(58) Field of Classification Search
CPC .. B41J 2/16526; B41J 2/1652; B41J 2/16517; B41J 2/0454; B41J 2/04571; B41J 2/04536; B41J 2/04551; B41J 2/04553; B41J 2/04581; B41J 2/04586; B41J 2/04588; B41J 2/04591; B41J 2/04593; B41J 29/38; B41J 29/393; B41J 2/07
See application file for complete search history.

(56) References Cited

U.S. PATENT DOCUMENTS 6,193,346 B1 2/2001 Nakano
9,636,908 B2 * 5/2017 Yamashita ..... B41J 2/04541

FOREIGN PATENT DOCUMENTS

JP H11-034325 A 2/1999
JP 2007-276287 A 10/2007

* cited by examiner

*Primary Examiner* — Thinh H Nguyen
(74) *Attorney, Agent, or Firm* — Banner & Witcoff, Ltd.

(57) ABSTRACT

In an inkjet printer, when an estimated viscosity of a first ink in a first nozzle is less than a threshold value, a power supply generates a first drive voltage, and when the estimated viscosity of the first ink is the threshold value or more, the power supply generates a second drive voltage higher than the first drive voltage. Moreover, at a time of vibrating a meniscus of a second ink in a second nozzle, when the first drive voltage is generated by the power supply, there is output to a drive element a first meniscus vibration signal, and when the second drive voltage is generated, there is output a second meniscus vibration signal by which energy imparted to the second ink by the drive element when applied to the drive element at an identical voltage level will be smaller compared to the first meniscus vibration signal.

14 Claims, 15 Drawing Sheets

Non-Discharge Signal

Discharge Signal (Medium Droplet)

Meniscus Vibration Signal 1

Meniscus Vibration Signal 2

Meniscus Vibration Signal 3

Meniscus Vibration Signal 4

Meniscus Vibration Signal 5

Meniscus Vibration Signal 6

Meniscus Vibration Signal 7

Fig. 6B

Non-Discharge Drive Setting Information
(Black Ink Normal Viscosity: Normal Voltage)

| Piezoelectric Element | Meniscus Vibration Signal |
|---|---|
| Black (K) | Meniscus Vibration Signal 4 |
| Yellow (Y) | Meniscus Vibration Signal 4 |
| Magenta (M) | Meniscus Vibration Signal 4 |
| Cyan (C) | Meniscus Vibration Signal 4 |

Fig. 6C

Non-Discharge Drive Setting Information
(Black Ink Viscosity Raised: High Voltage)

| Piezoelectric Element | Meniscus Vibration Signal |
|---|---|
| Black (K) | Meniscus Vibration Signal 4 |
| Yellow (Y) | Meniscus Vibration Signal 7 |
| Magenta (M) | Meniscus Vibration Signal 7 |
| Cyan (C) | Meniscus Vibration Signal 7 |

Fig. 6D

Non-Discharge Drive Setting Information
(Black Ink Viscosity Raised: Normal Voltage)

| Piezoelectric Element | Meniscus Vibration Signal |
|---|---|
| Black (K) | Meniscus Vibration Signal 1 |
| Yellow (Y) | Meniscus Vibration Signal 4 |
| Magenta (M) | Meniscus Vibration Signal 4 |
| Cyan (C) | Meniscus Vibration Signal 4 |

INK-JET PRINTER

CROSS REFERENCE TO RELATED APPLICATION

The present application claims priority from Japanese Patent Application No. 2017-163862 filed on Aug. 29, 2017, the disclosures of which is incorporated herein by reference in its entirety.

BACKGROUND

Field of the Invention

The present disclosure relates to an ink-jet printer.

Description of the Related Art

An ink-jet printer capable of jetting four colors of inks is known as an example of an ink-jet printer capable of jetting a plurality of kinds of inks. In a publicly known ink-jet printer, a channel linking a nozzle and an ink tank, and a piezoelectric element (a drive element), are provided for each ink color. Moreover, the piezoelectric element deforms when applied with a drive waveform of a certain voltage level, whereby ink is jetted from the nozzle.

Furthermore, in the above-described ink-jet printer, a preliminary waveform (a meniscus vibration signal) for vibrating a meniscus of ink in the nozzle without jetting the ink, is applied to the piezoelectric element at a certain voltage level, with an object of suppressing thickening of the ink in the nozzle. Moreover, it is focused on the fact that viscosity of the ink changes depending on the environmental temperature. Therefore, in the above-described ink-jet printer, the voltage level of the preliminary waveform is changed depending on an environmental temperature.

SUMMARY

According to an aspect of the present disclosure, there is provided an ink-jet printer including: a first nozzle configured to jet a first ink supplied from a first ink tank; a second nozzle configured to jet a second ink supplied from a second ink tank, the second ink being different from the first ink; a first drive element configured to impart energy to the first ink in the first nozzle; and a second drive element configured to impart energy to the second ink in the second nozzle; a power supply configured to generate a common drive voltage to be applied to the first drive element and the second drive element; and a controller. The controller is configured to execute: generating a jetting signal and a plurality of kinds of meniscus vibration signals, the jetting signal being applied to the first and second drive elements to jet the first ink and the second ink from the first nozzle and the second nozzle, respectively, the jetting signal having a voltage level corresponding to the drive voltage generated by the power supply, the plurality of kinds of meniscus vibration signals being applied to the first and second drive elements to vibrate a meniscus of the first ink in the first nozzles and a meniscus of the second ink in the second nozzles respectively without jetting the first and second inks, and the plurality of kinds of meniscus vibration signals having a voltage level corresponding to the drive voltage generated by the power supply; estimating a viscosity of the first ink in the first nozzle; under a condition that the estimated viscosity of the first ink in the first nozzle is less than a threshold value, controlling the power supply to generate a first drive voltage; under a condition that the estimated viscosity of the first ink in the first nozzle is equal to or greater than the threshold value, controlling the power supply to generate a second drive voltage being higher than the first drive voltage; and outputting one of the plurality of kinds of meniscus vibration signals to be applied to the second drive element to vibrate the meniscus of the second ink in the second nozzle. At a time of applying to the second drive element to vibrate the meniscus of the second ink in the second nozzle, the controller is configured to: output a first meniscus vibration signal of the plurality of kinds of meniscus vibration signals, in a case that the first drive voltage is generated by the power supply; and output a second meniscus vibration signal of the plurality of kinds of meniscus vibration signals, in a case that the second drive voltage is generated by the power supply, energy imparted to the second ink when the second meniscus vibration signal at a voltage level is applied to the second drive element being smaller than energy imparted to the first ink when the first meniscus vibration signal at the voltage level is applied to the first drive element.

In the present disclosure, when viscosity of the first ink in the first nozzle rises, the drive voltage rises from the first drive voltage to the second drive voltage, hence it can be suppressed that the first ink becomes un-jettable due to thickening of the ink.

Moreover, when the drive voltage generated by the power supply is the second drive voltage, the second meniscus vibration signal by which energy imparted to the ink in the second nozzle is smaller compared to the first meniscus vibration signal when the drive voltage is the first drive voltage, is output to the second drive element. As a result, a possibility of the second ink being mistakenly jetted can be reduced.

BRIEF DESCRIPTION OF THE DRAWINGS

FIGS. 6B, 6C, and 6D are views explaining non-jetting drive setting information.

DESCRIPTION OF THE EMBODIMENTS

Figure 1:
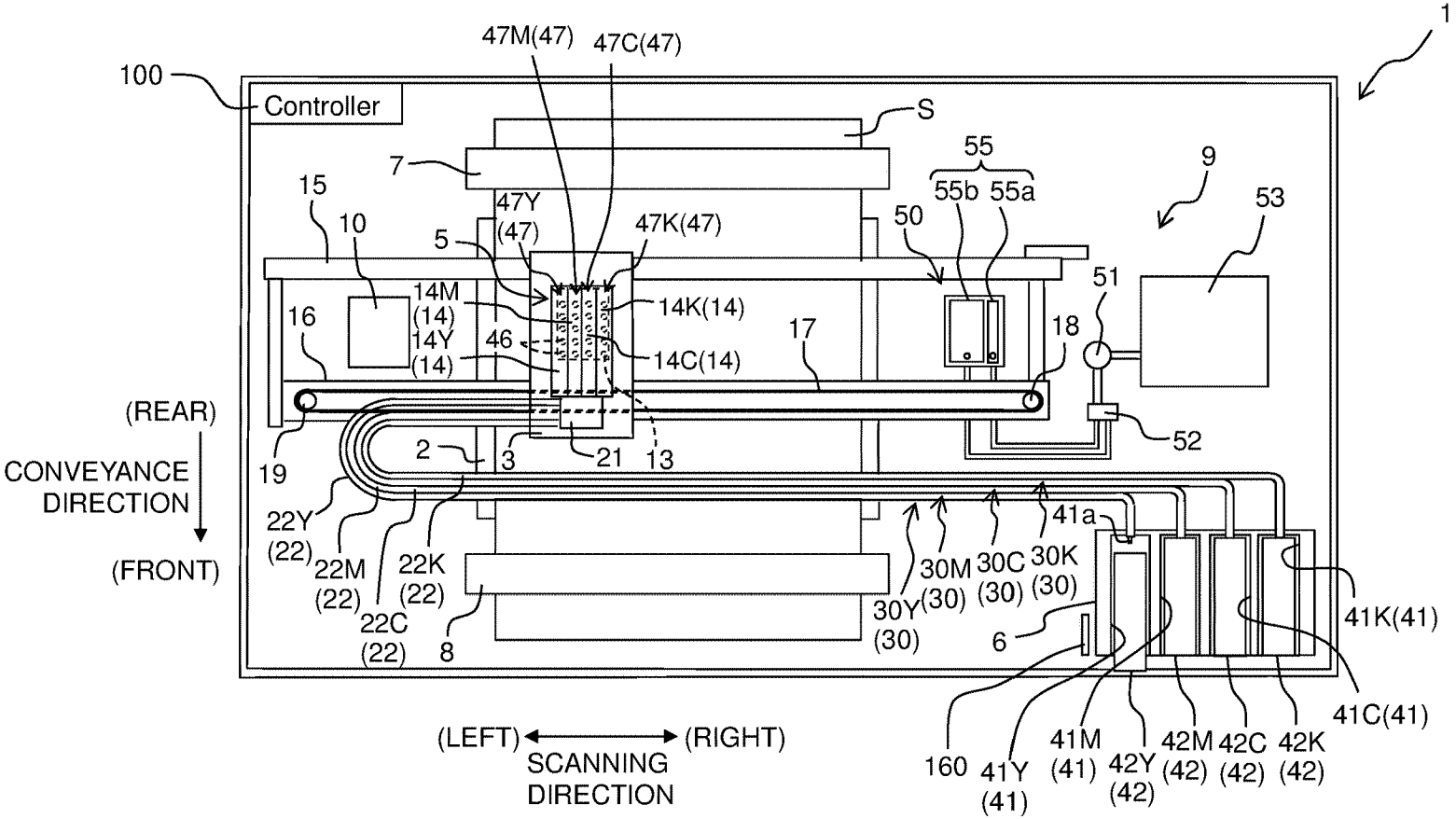
FIG. 1 is a schematic configurational view of an ink-jet printer according to the present embodiment.

There is also known an ink-jet printer in which a common drive voltage is applied to a plurality of drive elements corresponding to a plurality of kinds of inks. Moreover, generally, a drive waveform for jetting ink from a nozzle is set so that under standard conditions, an ink droplet of desired volume is jetted from the nozzle for each kind of ink.

Now, because respective compositions of each of the kinds of inks differ, sometimes, depending on circumstances, viscosity of ink in a nozzle for a certain kind of ink rises more than viscosity of ink in a nozzle for another kind of ink. For example, sometimes, as used inks of an ink-jet printer, a pigment ink is adopted for a certain ink color and a dye ink is adopted for another ink color. The above-described pigment ink has advantages such as that clarity and so on of a printed image improves. However, there is a problem that when in a state of having been left standing still for a long time, a pigment settles in a bottom section of an ink tank. When the pigment settles in the bottom section of the ink tank in this way, a pigment concentration of the pigment ink locally rises and its viscosity also locally rises in the bottom section of the ink tank. Therefore, when this pigment ink whose viscosity has risen is supplied to in the nozzle, it results in viscosity of the ink in the nozzle greatly rising. As a result, viscosity of the ink in the nozzle for the ink color using the pigment ink sometimes rises more greatly than viscosity of the ink in the nozzle for the ink color using the dye ink.

Moreover, sometimes, as used inks of an ink-jet printer, pigment inks are adopted for all of the ink colors. For each of these pigment inks, ease-of-settling of the pigments differ from each other due to differences in size of diameter of pigment particles or content rate of the pigment particles. Therefore, viscosity of the ink in the nozzle for a certain ink color sometimes rises more greatly than viscosity of the ink inside the nozzle for another ink color, due to settling of the pigment.

Moreover, sometimes, as used inks of an ink jet printer, a plurality of kinds of inks whose evaporation amounts per unit time differ from each other, are adopted. For example, in dye inks, because water content amounts differ depending on a kind of the dye ink, this leads to evaporation amounts per unit time differing from each other, and, as a result, degrees of progression of thickening of the inks differ from each other. Therefore, when, for example, dye inks have been adopted for all of the ink colors as used inks of an ink-jet printer, viscosity of the ink in the nozzle for a certain ink color where evaporation amount per unit time is large sometimes rises more greatly than viscosity of the ink inside the nozzle for another ink color where evaporation amount per unit time is small, due to evaporation of water.

When viscosity of the ink in the nozzle for a certain kind of ink rises in this way, a problem may occur that, due to an increase in frictional resistance inside a channel, an ink droplet of the certain kind of ink cannot be jetted from the nozzle. Therefore, in order to jet the ink droplet of the certain kind of ink from the nozzle, the above-described common drive voltage must be increased. However, when the common drive voltage is increased, a problem occurs that, when the drive element corresponding to another kind of ink is applied with a meniscus vibration signal having a voltage level based on said drive voltage, ink is mistakenly jetted from the nozzle.

Accordingly, in the present embodiment, there is provided an ink-jet printer that enables mistaken jetting of ink to be reduced.

A schematic configuration of an ink-jet printer 1 according to the present embodiment will be described. As depicted in FIG. 1, the printer 1 includes a platen 2, a carriage 3, an ink-jet head 5 (hereafter, also referred to simply as a head 5), a holder 6, a paper feed roller 7, a paper discharge roller 8, a maintenance unit 9, a flushing receiver 10, a power supply circuit 60 (refer to FIG. 2), a temperature sensor 160, and a controller 100. Note that hereafter, front side of the paper surface of FIG. 1 will be defined as an "upper side" of the printer 1, and the back side of the paper surface of FIG. 1 will be defined as a "lower side" of the printer 1. Moreover, a front-rear direction and a left-right direction depicted in FIG. 1 will be defined as a "front-rear direction" and a "left-right direction" of the printer 1.

A sheet S as a recording medium is placed on an upper surface of the platen 2. In addition, two guide rails 15, 16 extending in parallel with the left-right direction (a scanning direction) are provided above the platen 2. The carriage 3 is attached to the two guide rails 15, 16, and is movable in the left-right direction along the two guide rails 15, 16 in a region facing the platen 2. Moreover, a drive belt 17 is attached to the carriage 3. The drive belt 17 is an endless belt wound around two pulleys 18, 19. One pulley 18 is coupled to a carriage drive motor 20 (refer to FIG. 2). The pulley 18 is rotary-driven by the carriage drive motor 20, causing the drive belt 17 to run, and this results in the carriage 3 making reciprocating movement in the left-right direction. Moreover, as a result, at this time, the head 5 mounted on the carriage 3 makes reciprocating movement in the left-right direction along with this carriage 3.

The holder 6 includes four cartridge attaching sections 41 aligned in the left-right direction. An ink cartridge 42 is attached in an attachable/detachable manner to each of the cartridge attaching sections 41. The four ink cartridges 42 attached to the four cartridge attaching sections 41 respectively store black, yellow, cyan, and magenta inks. Note that in the description below, for convenience, those of the configuring elements of the ink-jet printer that respectively correspond to the black (K), yellow (Y), cyan (C), and magenta (M) inks are assigned with any one of symbols "K" indicating black, "Y" indicating yellow, "C" indicating cyan, and "M" indicating magenta after the symbol indicating that configuring element, in order that it can be understood to which ink the configuring element corresponds. For example, ink cartridge 42K indicates the ink cartridge 42 storing black ink. Note that in the present embodiment, the black ink is a pigment ink, and the color inks other than that black ink, that is, the yellow, cyan, and magenta inks are dye inks.

Figure 3:
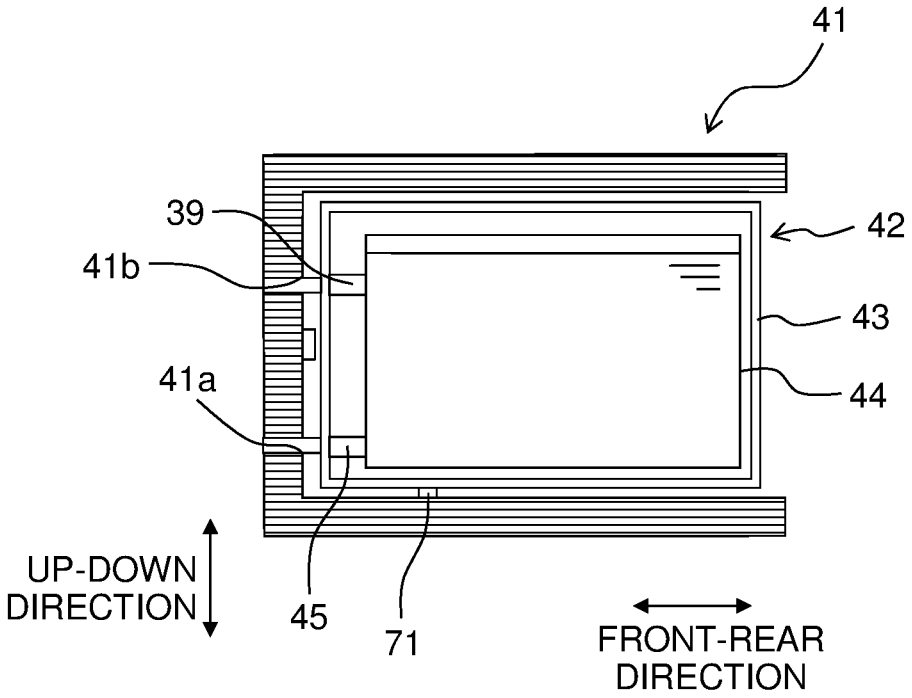
FIG. 3 is a side cross-sectional view of an ink cartridge and a cartridge attaching section, showing a state where the ink cartridge is attached to the cartridge attaching section.

As depicted in FIG. 3, the ink cartridge 42 includes: a casing 43 of substantially rectangular parallelepiped shape; a storage chamber 44 of substantially rectangular parallelepiped shape disposed inside the casing 43 and storing the ink; a discharge tube 45 connected to a lower section of the storage chamber 44; and an air communicating section 39 connected to the storage chamber 44.

The discharge tube 45 demarcates a channel for supplying to outside of the ink cartridge 42 the ink stored in the storage chamber 44. The cartridge attaching section 41 includes a needle 41*a* that, when the ink cartridge 42 has been attached to the cartridge attaching section 41, is connected to this discharge tube 45 to circulate the ink.

The air communicating section 39 includes a channel that communicates the storage chamber 44 and outside of the ink cartridge 42, and a valve provided on said channel. By this valve opening when the ink cartridge 42 has been attached to the cartridge attaching section 41, the storage chamber 44 communicates with air via an air communicating channel 41*b* formed in the cartridge attaching section 41. Moreover, the cartridge attaching section 41 is provided with a sensor 71 for detecting whether the ink cartridge 42 is attached to the cartridge attaching section 41, or not.

As depicted in FIG. 1, the head 5 is mounted in the carriage 3. This head 5 includes a head main body 13 and four sub-tanks 14 (14K, 14Y, 14M, 14C). The four sub-tanks 14 are disposed aligned along the left-right direction. In addition, these four sub-tanks 14 are integrally provided with a tube joint 21. Moreover, respective one ends of four ink supply tubes 22 (22K, 22Y, 22M, 22C) having flexibility are connected in an attachable/detachable manner to the tube joint 21. Respective other ends of the four ink supply tubes 22 are connected to respective needles 41*a* of the four cartridge attaching sections 41 (41K, 41Y, 41M, 41C) of the holder 6. The inks inside the four ink cartridges 42 attached to the cartridge attaching sections 41 are respectively supplied to the four sub-tanks 14 via these four ink supply tubes 22.

The head main body 13 is attached to lower sections of the four sub-tanks 14. A lower surface of the head main body 13 is a nozzle surface in which are formed a plurality of nozzles 46 for jetting the ink. The nozzle surface has formed therein four of nozzle arrays 47 aligned in the left-right direction. In each of the nozzle arrays 47, a plurality of nozzles 46 are arranged in the front-rear direction. These four of nozzle arrays 47 are configured from a nozzle array 47Y that jets yellow ink, a nozzle array 47M that jets magenta ink, a nozzle array 47C that jets cyan ink, and a nozzle array 47K that jets black ink. A detailed configuration of the head main body 13 will be mentioned later.

Figure 2:
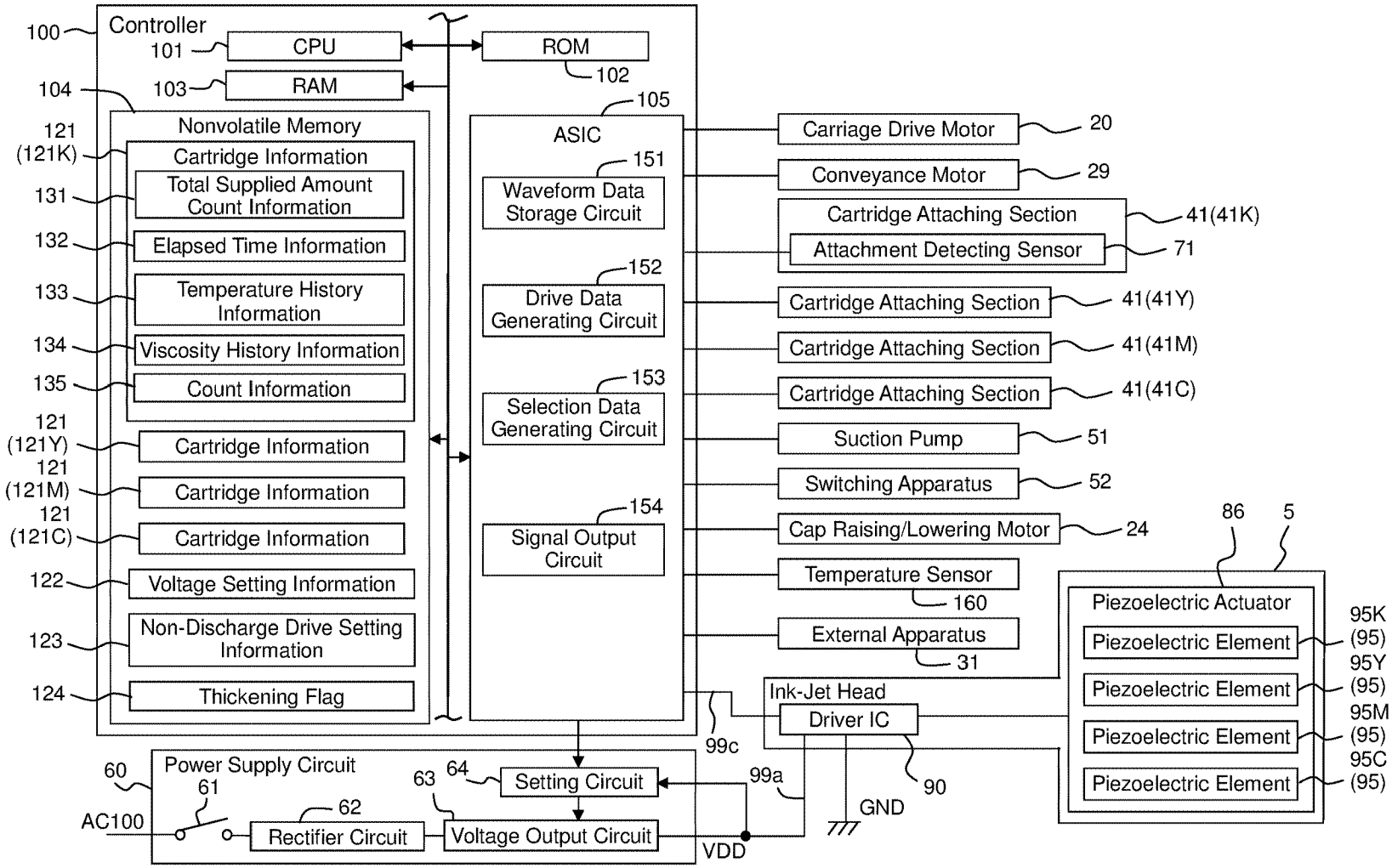
FIG. 2 is a block diagram schematically showing an electrical configuration of the ink-jet printer.

The paper feed roller 7 and the paper discharge roller 8 are each synchronously rotary-driven by a conveyance motor 29 (refer to FIG. 2). The paper feed roller 7 and the paper discharge roller 8 cooperate to convey to the front (in the conveyance direction) the sheet S placed on the platen 2.

Then, the printer 1, while conveying the sheet S in the conveyance direction by the paper feed roller 7 and the paper discharge roller 8, jets ink while moving the head 5 in the left-right direction (the scanning direction) along with the carriage 3, thereby printing a desired image, or the like, on the sheet S. That is, the printer 1 of the present embodiment is a serial type ink-jet printer. Note that in the present embodiment, ink is jetted from the nozzle 46 only when the head 5 is moved to the left, and, when the head 5 is moved (returned) to the right, ink is not jetted from the nozzle 46.

The flushing receiver 10 is disposed more to the left side than the platen 2. When the carriage 3 is moved whereby the head 5 is positioned in a flushing position, the plurality of nozzles 46 attain a facing state of facing the flushing receiver 10 in an up-down sense. Moreover, in the printer 1, in a state where the head 5 has been positioned in the flushing position, the head 5 can be caused to perform a flushing that jets ink by jetting the ink toward the flushing receiver 10 from the nozzles 46.

The maintenance unit 9 performs a maintenance operation for maintenance and recovery of a jetting function of the head 5. The maintenance unit 9 includes a cap unit 50, a suction pump 51, a switching apparatus 52, and a waste liquid tank 53.

The cap unit 50 is disposed more to the right side than the platen 2. When the carriage 3 is moved more to the right side than the platen 2, the carriage 3 faces this cap unit 50 in an up-down sense. Moreover, the cap unit 50 is driven by a cap raising/lowering motor 24 (refer to FIG. 2), whereby the cap unit 50 can be raised/lowered in the up-down direction. This cap unit 50 includes a cap 55 attachable/detachable by contacting the head 5. The cap 55 is configured by a rubber material, for example, and has a black cap section 55*a* and a color cap section 55*b*.

In a state where the carriage 3 faces the cap unit 50, the cap 55 faces a lower surface of the head main body 13. Moreover, when the cap unit 50 rises in a state where the carriage 3 and the cap unit are facing, the cap unit 50 is attached to the head 5. At this time, the nozzle array 47K is covered by the black cap section 55*a*, and the three columns of nozzle arrays 47Y, 47M, 47C are commonly covered by the color cap section 55*b*.

The black cap section 55*a* and the color cap section 55*b* are each connected to the suction pump 51 via the switching apparatus 52. The switching apparatus 52 selectively switches a communication destination of the suction pump 51 between the black cap section 55*a* and the color cap section 55*b*. The waste liquid tank 53 is connected to the suction pump 51 on an opposite side to the switching apparatus 52.

Moreover, in the printer 1, the maintenance unit 9 can be caused to perform a suction purge that forcibly jets ink from the nozzle 46, as the maintenance operation, under control of the controller 100.

Specifically, when performing a suction purge forcibly jetting black ink from the nozzle 46K belonging to the nozzle array 47K, the black cap section 55*a* is communicated with the suction pump 51 in a state where the nozzle array 47K is covered by the black cap section 55*a*, whereupon the suction pump 51 is driven. As a result, internal pressure of the black cap section 55*a* becomes negative, whereby the black ink is forcibly jetted from the nozzle 46K of the nozzle array 47K.

Similarly, when performing a suction purge forcibly jetting color inks from the nozzles 46Y 46M, 46C belonging to the nozzle arrays 47Y, 47M, 47C, the color cap section 55*b* is communicated with the suction pump 51 in a state where the nozzle arrays 47Y, 47M, 47C are covered by the color cap section 55*b*, whereupon the suction pump 51 is driven.

As depicted in FIG. 2, the power supply circuit 60 includes a power supply switch 61, a rectifier circuit 62, a voltage output circuit 63, and a setting circuit 64. The power supply switch 61 performs connection to a 100 V AC power supply and performs disconnection from the AC power supply. The rectifier circuit 62 converts an AC voltage supplied from the AC power supply to a DC voltage. Moreover, at this time, a voltage is stepped down from 100 V to a voltage lower than 100 V (for example, about 30 V). The DC voltage from the rectifier circuit 62 is supplied to the voltage output circuit 63. In the voltage output circuit 63, an output voltage (VDD) for driving a variety of drive sections configuring the printer 1 such as a driver IC 90 that will be mentioned later, is generated and output. Moreover, the voltage output circuit 63 also functions to switch supply/non-supply of an output voltage to each of the drive sections for the generated output voltage. The setting circuit 64 is a PMW circuit for carrying out setting on the voltage output circuit 63 of a control target value of feedback control for maintaining the output voltage at a certain voltage. The power supply circuit 60 is configured capable of outputting multiple levels of voltages.

The temperature sensor 160 is disposed in a vicinity of the holder 6, and measures an ambient temperature.

The controller 100 includes a CPU (Central Processing Unit) 101, a ROM (Read Only Memory) 102, a RAM (Random Access Memory) 103, a nonvolatile memory 104, and an ASIC (Application Specific Integrated Circuit) 105. The ROM 102 stores a program executed by the CPU 101, various kinds of fixed data, and so on. The RAM 103 temporarily stores data (printing data, and so on) required during program execution. The ASIC 105 is connected to various apparatuses or drive sections of the printer 1 such as the head 5 and the carriage drive motor 20. In addition, the ASIC 105 is connected to an external apparatus 31 such as a PC.

The controller 100 controls the head 5 or the carriage drive motor 20 based on a print instruction received from the external apparatus 31, and thereby executes a print processing that prints an image, or the like, on the sheet S. As print modes of this print processing, the present embodiment has: a first print mode where printing is performed using black ink; and a second print mode where printing is performed using only color inks without black ink being used. A photograph printing-oriented mode, for example, is cited as the second print mode.

Note that in the present embodiment, various kinds of processing such as the print processing that are performed by the controller 100 may be performed by a single CPU, or may be performed by cooperation of a CPU and an ASIC. Moreover, the controller 100 may include a plurality of CPUs, and processing may be performed in a shared manner by the plurality of CPUs. In addition, the controller 100 may include a plurality of ASICs, and processing may be shared by the plurality of ASICs. Alternatively, processing may be performed independently by one ASIC.

Figure 4A:
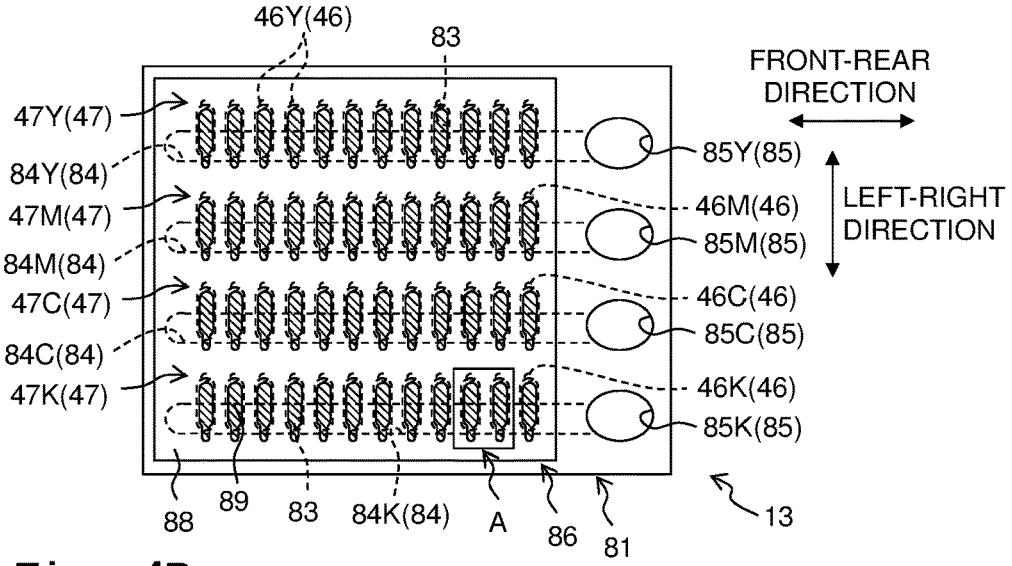
FIG. 4A is a plan view of a head main body.

Next, the head main body 13 will be described in detail. As depicted in FIG. 4A, the head main body 13 includes: a channel structure 81 having formed therein a plurality of the nozzles 46 and a plurality of pressure chambers 83 that respectively communicate with the plurality of nozzles 46; and a piezoelectric actuator 86 disposed on an upper surface of the channel structure 81.

Figure 4B:
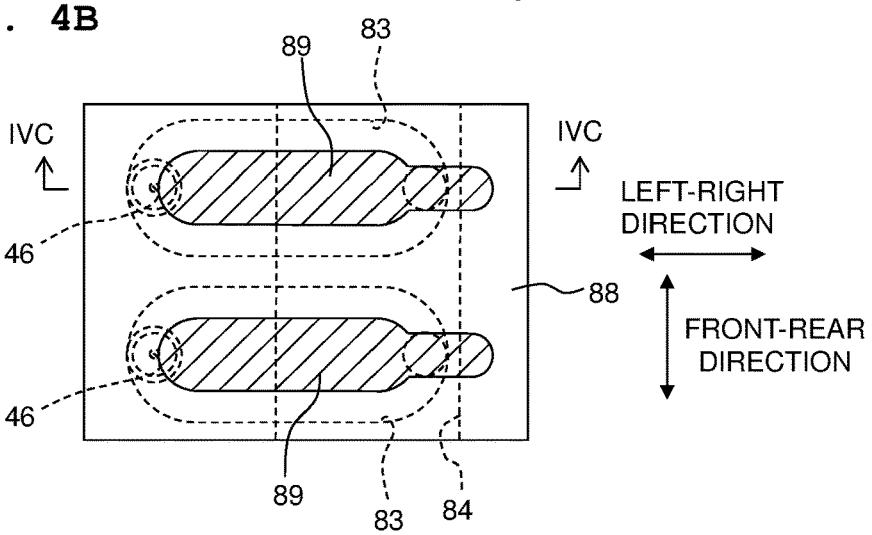
FIG. 4B is an enlarged view of section A of FIG. 4A.
Figure 4C:
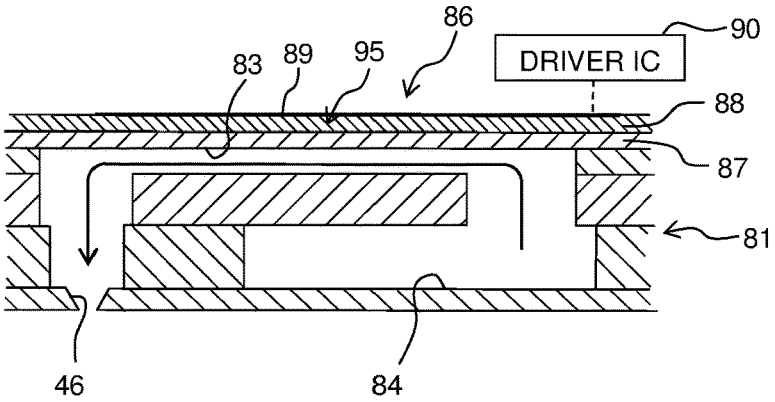
FIG. 4C is a cross-sectional view taken along the line B-B of FIG. 4B.

As depicted in FIG. 4C, the channel structure 81 has a structure in which four plates have been laminated. The plurality of nozzles 46 are formed in a lower surface of this channel structure 81. As depicted in FIG. 4A, the plurality of nozzles 46 are arranged in the front-rear direction (the conveyance direction of the sheet S), and configure four of the nozzle arrays 47 respectively corresponding to the four colors of inks. The plurality of pressure chambers 83 are arranged in four arrays similarly to the plurality of nozzles 46.

Furthermore, as depicted in FIGS. 4A and 4B, the channel structure 81 has formed therein four manifolds 84 (84K, 84Y, 84M, 84C) each extending in the front-rear direction. The four manifolds 84 respectively supply the four colors of inks to four of pressure chamber arrays. Moreover, the four manifolds 84 are connected to four ink supply holes 85 (85K, 85Y, 85M, 85C) formed in the upper surface of the channel structure 81. The four ink supply holes 85 are respectively supplied with the four colors of inks from the four sub-tanks 14 (refer to FIG. 1). Due to the above configuration, a plurality of individual channels branching from each of the manifolds 84 to reach the nozzles 46 via the pressure chambers 83, are formed inside the channel structure 81.

As depicted in FIG. 4C, the piezoelectric actuator 86 includes: a vibrating plate 87 covering the plurality of pressure chambers 83; a piezoelectric layer 88 disposed on an upper surface of this vibrating plate 87; and a plurality of individual electrodes 89 corresponding to the plurality of pressure chambers 83. The plurality of individual electrodes 89 positioned on an upper surface of the piezoelectric layer 88 are each electrically connected to the driver IC 90 driving the piezoelectric actuator 86. As depicted in FIG. 2, wirings such as a power supply line 99*a*, a ground line 99*b*, and a control signal line 99*c* are connected to the driver IC 90. The power supply line 99*a* supplies the driver IC 90 with the output voltage generated by the power supply circuit 60. The ground line 99*b* connects the driver IC 90 to ground. The control signal line 99*c* inputs to the driver IC 90 from the controller 100 a control signal such as pulse waveform data or waveform selection data that will be described later.

The vibrating plate 87 positioned on a lower surface of the piezoelectric layer 88 is formed by a metal material, and functions as a common electrode facing the plurality of individual electrodes 89 sandwiching the piezoelectric layer 88. Note that this vibrating plate 87 is connected to the ground line 99*b* of the driver IC 90 and is thereby always held at ground potential.

In the above configuration, one piezoelectric element 95 (refer to FIG. 4C) is configured by: one individual electrode 89; an electrode portion facing one pressure chamber 83, of the vibrating plate 87 as the common electrode; and a portion facing the one pressure chamber 83, of the piezoelectric layer 88.

The driver IC 90 outputs a drive pulse signal to the individual electrode 89 of each of the piezoelectric elements 95 and switches a voltage applied to the individual electrode 89 between High level and Low level, based on a control signal from the controller 100. High level is a level of output voltage received from the power supply circuit 60 via the power supply line 99*a*, and Low level is a ground level. In this way, in the present embodiment, the output voltage output by the power supply circuit 60 is commonly applied to each of the piezoelectric elements 95.

Operation at a time of jetting ink from the nozzle 46, of the above-described piezoelectric actuator 86 is as follows. A voltage of the individual electrode 89 of a certain piezoelectric element 95 is assumed to have been switched from Low to High by the driver IC 90. At this time, a potential difference occurs between the individual electrode 89 and the vibrating plate 87 as the common electrode, and piezoelectric deformation occurs in the piezoelectric layer 88 sandwiched between the two. This piezoelectric deformation of the piezoelectric layer 88 causes a volume change to occur in the pressure chamber 83, whereby a pressure (energy) is imparted to the ink inside the pressure chamber 83 (nozzle 46). As a result, a droplet of ink is jetted from the nozzle 46 communicating with the above-described pressure chamber 83.

As stated above, each of the piezoelectric elements 95 is driven by being input with the drive pulse signal. Note that there are two kinds of drive pulse signals, namely, a "jetting signal" and a "meniscus vibration signal". When the jetting signal is output to the piezoelectric element 95, the volume change occurs in the pressure chamber 83, whereby the droplet of ink is jetted from the nozzle 46. In contrast, when the meniscus vibration signal is output, a volume change of the pressure chamber 83 occurs, but a droplet of ink is not jetted from the nozzle 46. Instead, vibration of a meniscus is induced in the ink in the nozzle 46. By vibrating the meniscus of the ink in the nozzle 46 in this way, the ink in the nozzle 46 is agitated, whereby thickening is suppressed. Hereafter, drive due to the former will be referred to as "jetting drive", and drive due to the latter will be referred to as "non-jetting drive". Moreover, hereafter, for convenience, an overall channel from the needle 41*a* to the plurality of nozzles 46 will be collectively referred to as an ink channel 30 (30K, 30Y, 30M, 30C), as depicted in FIG. 1.

Next, details of electrical configuration for driving the above-described piezoelectric actuator 86 will be described.

First, a configuration of the driver IC 90 that supplies the drive pulse signal to the piezoelectric actuator 86 will be described.

The driver IC 90 selects for supply to the individual electrode 89 of the piezoelectric element 95 one kind of signal from among 11 kinds of signals (refer to FIG. 5), in each jetting cycle (a cycle during which one dot is formed on the sheet S). Note that for convenience of explanation, only eight kinds of signals of the 11 kinds of signals are illustrated in FIG. 5.

Figure 5A:
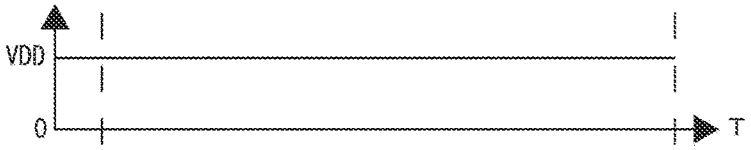
FIGS. 5A to 5I are waveform charts of signals (a non-jetting signal, a jetting signal, and meniscus vibration signals) supplied to a piezoelectric actuator from a driver IC.
Figure 5B:
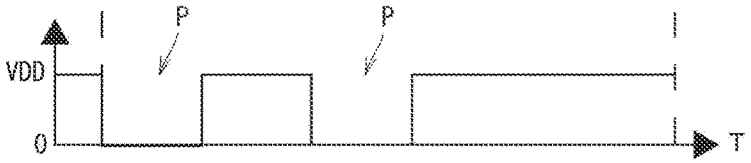
Figure 5C:
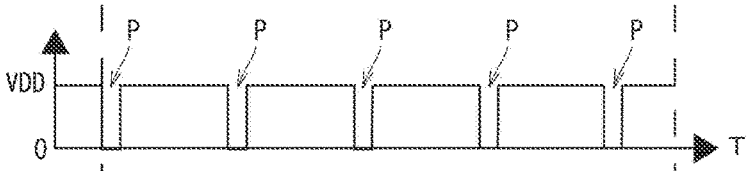
Figure 5D:
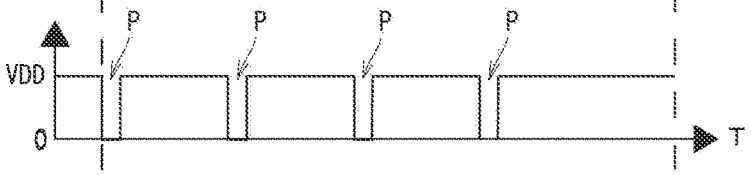
Figure 5E:
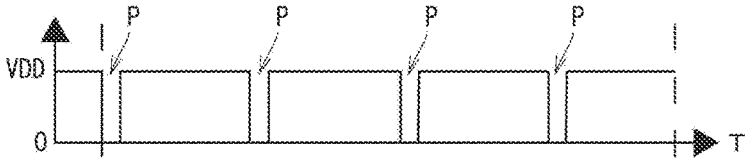
Figure 5F:
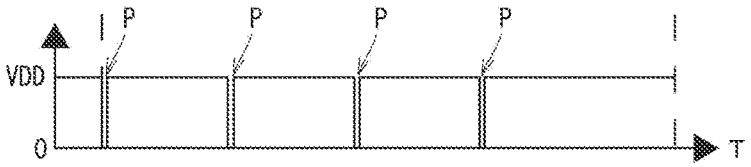
Figure 5G:
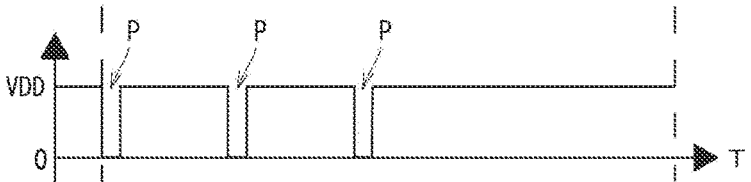
Figure 5H:
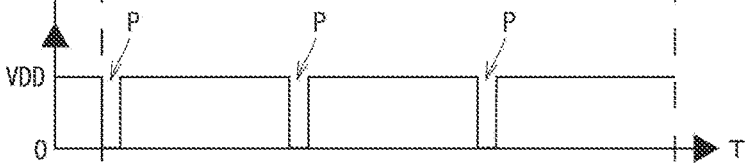
Figure 5I:
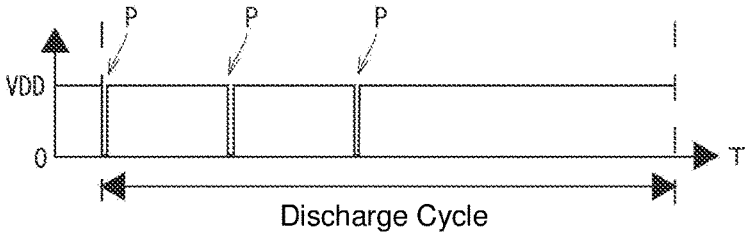

One kind of signal (refer to FIG. 5A), of these 11 kinds of signals is a non jetting signal not having a pulse P, and 10 kinds of signals, of these 11 kinds of signals are drive pulse signals having the pulse P. Note that only eight kinds of signals, of the 10 kinds of signals are illustrated in FIGS. 5B-5I. Moreover, three kinds of signals, of the 10 kinds of drive pulse signals are jetting signals for jetting three kinds of droplets (small droplet, medium droplet, large droplet) of differing sizes from one nozzle 46, in order to enable multi-gradation printing. Note that only one kind of signal, of the three kinds of signals is illustrated in FIG. 5B. The three kinds of jetting signals are drive pulse signals whose pulse waveforms differ from each other, and, in the present embodiment, the number of pulses P included in one jetting cycle differ. The remaining seven kinds of signals (refer to FIGS. 5C-5I), of the 10 kinds of drive pulse signals are meniscus vibration signals for vibrating the meniscus of the ink in the nozzle 46 without jetting the ink. Hereafter, these will be referred to as meniscus vibration signals 1-7. The meniscus vibration signal has the pulse P similarly to the jetting signal, but its pulse width is smaller compared to that of the jetting signal. Therefore, in the case where each have been output to the piezoelectric element 95 at identical voltage levels, energy imparted to the ink in the nozzle 46 is larger for the jetting signal compared to for the meniscus vibration signal.

The meniscus vibration signals 1-7 undergo adjustment of the pulse width of the pulse P, the number of pulses P, and a pulse interval of a plurality of the pulses P included in one jetting cycle. As a result, the meniscus vibration signals 1-7 are set so that energies imparted to the ink in the nozzle 46 when they have been output to the piezoelectric element 95 at identical voltage levels, differ from each other. Specifically, they are set so that energy imparted to the ink in the nozzle 46 is largest by the meniscus vibration signal 1, gets smaller in order of the meniscus vibration signals 2, 3, 4, 5, 6, and is smallest by the meniscus vibration signal 7.

Now, meniscus vibration signals for which conditions of the numbers-of-pulses of pulses P and the pulse intervals of a plurality of the pulses P included in one jetting cycle are the same, will be considered. In this case, the larger the pulse width of the pulse P a meniscus vibration signal has, the larger a deformation amount of the piezoelectric element 95 per one pulse P will be. Therefore, the larger the pulse width of the pulse P a meniscus vibration signal has, the larger energy imparted to the ink in the nozzle 46 will be. For example, in the meniscus vibration signal 5 (refer to FIG. 5G) and the meniscus vibration signal 7 (refer to FIG. 5I), the numbers-of-pulses of pulses P and the pulse intervals of the plurality of pulses P included in one jetting cycle are the same as each other. However, the pulse width of the pulse P is larger for the meniscus vibration signal 5 than for the meniscus vibration signal 7. Therefore, energy imparted to the ink in the nozzle 46 is larger by the meniscus vibration signal 5 than by the meniscus vibration signal 7.

Fellow meniscus vibration signals for which conditions of the pulse widths of the pulse P and the pulse intervals of a plurality of the pulses P included in one jetting cycle are the same, will be considered. In this case, the larger the number-of-pulses of pulses P a meniscus vibration signal has, the larger the number of times of deformations of the piezoelectric element 95 will be, and the larger energy imparted to the ink in the nozzle 46 will be. For example, in the meniscus vibration signal 2 (refer to FIG. 5D) and the meniscus vibration signal 5 (refer to FIG. 5G), the pulse widths of the pulse P and the pulse intervals of the plurality of pulses P included in one jetting cycle are the same as each other. However, the number of pulses P is larger for the meniscus vibration signal 2 than for the meniscus vibration signal 5. Therefore, energy imparted to the ink in the nozzle 46 is larger by the meniscus vibration signal 2 than by the meniscus vibration signal 5.

Moreover, even in the case of fellow meniscus vibration signals whose pulse widths of the pulse P and numbers of pulses P are in the same condition, sometimes, if the pulse intervals of the plurality of pulses P included in one jetting cycle differ, energies imparted to the ink in the nozzle 46 will differ from each other. For example, by adjusting the pulse intervals of the pulses P successively output in one jetting cycle so that energies imparted by each of the pulses P are superimposed, it is possible for a large energy to be imparted to the ink in the nozzle 46. When a certain pulse P is output, it results in a pressure wave occurring in the ink inside the pressure chamber. If, at a timing when that pressure wave has returned after being reflected by a wall surface of an end section of the pressure chamber, a pressure wave is caused to occur in the ink by the next pulse P, then the two pressure waves overlap so as to intensify, whereby a large energy can be imparted to the ink. For example, in the meniscus vibration signal 5 (FIG. 5G) and the meniscus vibration signal 6 (FIG. 5H), the pulse widths of the pulse P and the numbers of pulses P are the same as each other. However, the pulse interval of the meniscus vibration signal 5 is adjusted so that imparted pressure waves generated due to each of the pulses P are superimposed on each other. Therefore, energy imparted to the ink in the nozzle 46 is larger for the meniscus vibration signal 5 than for the meniscus vibration signal 6.

As stated above, each of the meniscus vibration signals 2-7 is set so that, compared to a meniscus vibration signal for which energy imparted to the ink in the nozzle 46 within one jetting cycle when there are identical voltage levels is larger than for said one of the meniscus vibration signals 2-7, each of the meniscus vibration signals 2-7 satisfies at least one condition of the following three conditions.

Condition 1: the pulse width of the pulse P is small

Condition 2: the number of pulses P included in one jetting cycle is small

Condition 3: the pulse intervals of the plurality of pulses P included in one jetting cycle differ The driver IC 90 selects for output to the individual electrode 89 of each of the piezoelectric elements 95 one of the 11 kinds of signals, based on the later-mentioned waveform selection data transmitted from the controller 100.

Figure 6A:
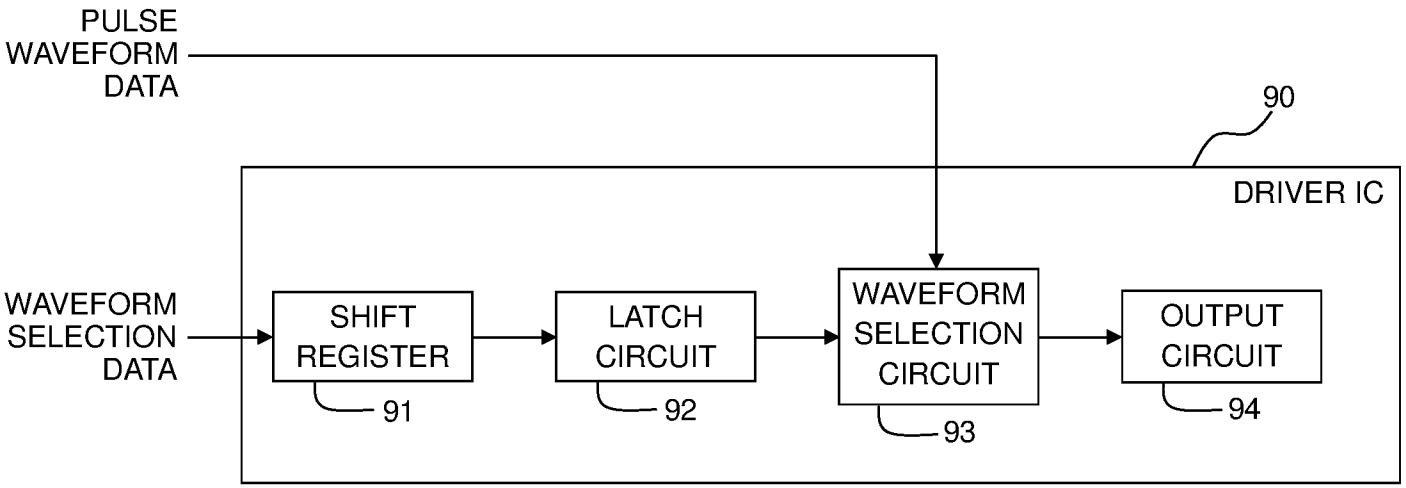
FIG. 6A is a block diagram schematically showing a circuit configuration of the driver IC.

As depicted in FIG. 6A, the driver IC 90 has a shift register 91, a latch circuit 92, a waveform selection circuit 93, and an output circuit 94. The waveform selection data respectively corresponding to the plurality of piezoelectric elements 95 are input to the shift register 91 from the controller 100. The waveform selection data corresponding to one piezoelectric element 95 is multi-bit bit data for selecting one kind of signal from the above-described 11 kinds of signals in the later-mentioned waveform selection circuit 93. Moreover, a total bit number of the waveform selection data corresponding to the plurality of piezoelectric elements 95 in one jetting cycle is (bit number of one item of waveform selection data)×(total number of piezoelectric elements 95), and these bit data are serially input to the driver IC 90 from the controller 100.

The shill register 91 performs parallel conversion of the above-described serially input numerous items of bit data, and sequentially outputs them to the latch circuit 92. Moreover, the latch circuit 92 holds the bit data (waveform selection data) that has undergone parallel outputting from the shift register 91 until input of all data related to one jetting cycle has been completed. Then, when input of all of the waveform selection data has been completed, the waveform selection data being held undergoes parallel outputting to the waveform selection circuit 93.

The pulse waveform data of the 11 kinds of signals (refer to FIG. 5) is input to the waveform selection circuit 93 from the controller 100. Then, the waveform selection circuit 93 selects one kind from among the 11 kinds of signals, based on the waveform selection data corresponding to each of the plurality of individual electrodes 89, that have been input from the latch circuit 92, and outputs the waveform signal of that one kind of signal to the output circuit 94.

The waveform signal output from the waveform selection circuit 93 is a signal of a control voltage level of a logic circuit such as the shift register 91, the latch circuit 92, and the waveform selection circuit 93. Then, the output circuit 94 amplifies this waveform signal that has been input from the waveform selection circuit 93, to a voltage level corresponding to the output voltage output by the power supply circuit 60, thereby generating the drive pulse signal, and outputs the drive pulse signal to the individual electrode 89 of the piezoelectric element 95.

Next, a configuration of the ASIC 105 of the controller 100, for driving the above-described piezoelectric actuator 86, will be described. As depicted in FIG. 2, the ASIC 105 has a waveform data storage circuit 151, a drive data generating circuit 152, a selection data generating circuit 153, and a signal output circuit 154. The waveform data storage circuit 151 stores data related to pulse waveforms (pulse waveform data) of the 11 kinds of signals (refer to FIG. 5).

The drive data generating circuit 152 generates drive data related to drive of each of the piezoelectric elements 95 in respective jetting cycles during print processing, based on the printing data. Note that in the present embodiment, the controller 100 executes non-jetting drive processing in which, during the print processing, the controller 100 outputs a meniscus vibration signal to the piezoelectric element 95 in a certain jetting cycle, thereby causing the piezoelectric element 95 to perform non-jetting drive. As will be mentioned later, the drive data is data that synthesizes jetting drive data related to jetting drive and non-jetting drive data related to non-jetting drive.

Moreover, the nonvolatile memory 104 stores non-jetting drive setting information 123. The non-jetting drive setting information 123 relates to the kind of meniscus vibration signal output to each of the piezoelectric elements 95K, 95Y, 95M, 95C during the above-described non-jetting drive processing. The following kinds of meniscus vibration signals are set in the non-jetting drive setting information 123. When viscosity of the ink in the nozzle 46K jetting black ink is a normal viscosity (a viscosity of a threshold value or less), the meniscus vibration signal 4 is set as the meniscus vibration signal output to each of the piezoelectric elements 95K, 95Y, 95M, 95C (refer to FIG. 6B). The meniscus vibration signal 4 is also referred to as a normal-use meniscus vibration signal. Moreover, regarding the non-jetting drive setting information 123, when viscosity of the ink in the nozzle 46K has risen to the threshold value or more whereby the output voltage of the power supply circuit 60 is raised from a normal voltage to a high voltage, the meniscus vibration signals output to the piezoelectric elements 95Y 95M, 95C have their settings changed from the meniscus vibration signal 4 to any of the meniscus vibration signals 5-7 (refer to FIG. 6C). The meniscus vibration signals 5-7 are also referred to as high voltage-oriented meniscus vibration signals. At this time, the meniscus vibration signal output to the piezoelectric element 95K is set to the meniscus vibration signal 4, with the output voltage of the power supply circuit 60 being set in the same way as the normal voltage.

On the other hand, the output voltage of the power supply circuit 60 is sometimes maintained at the normal voltage even when viscosity of the ink in the nozzle 46K has risen to the threshold value or more. At such a time, regarding the non-jetting drive setting information 123, the meniscus vibration signal Output to the piezoelectric element 95K has its setting changed from the meniscus vibration signal 4 to any of the meniscus vibration signals 1-3 (refer to FIG. 6D). The meniscus vibration signals 1-3 are also referred to as high viscosity-oriented meniscus vibration signals. At this time, the meniscus vibration signals output to the piezoelectric elements 95Y, 95M, 95C are set to the meniscus vibration signal 4.

The selection data generating circuit 153 generates the waveform selection data for selecting one from the 11 kinds of pulse waveforms, in each jetting cycle, for each of the piezoelectric elements 95, based on the drive data generated by the drive data generating circuit 152 and on the non-jetting drive setting information 123.

The signal output circuit 154 outputs to the driver IC 90 the pulse waveform data stored in the waveform data storage circuit 151 and the waveform selection data generated by the selection data generating circuit 153. On receiving these, the driver IC 90 generates for each of the plurality of piezoelectric elements 95 a drive pulse signal of a voltage level based on the output voltage generated by the power supply circuit 60, and respectively supplies the drive pulse signals to the plurality of piezoelectric elements 95.

Next, the drive data generating circuit 152 will be described. The drive data generating circuit 152, upon receiving from the CPU 101 an instruction for generation of drive data, first, generates jetting drive data related to jetting drive, based on the printing data received from the external apparatus 31. This jetting drive data is data that indicates for each of the piezoelectric elements 95 presence/absence of output of the jetting signal in each jetting cycle and, in the case of the jetting signal being output, the kind of that jetting signal (small droplet, medium droplet, large droplet).

After this, the drive data generating circuit 152 generates the non-jetting drive data related to non-jetting drive, based on the printing data or the jetting drive data. This non-jetting drive data is data that indicates for each of the piezoelectric elements 95 presence/absence of output of the meniscus vibration signal in each jetting cycle. Hereafter, one example of generation of the non-jetting drive data will be described. The drive data generating circuit 152, based on the jetting drive data, extracts for each of the piezoelectric elements 95 jetting cycles in which jetting drive is not performed and counts a consecutive number of times thereof (a non-jetting period). This non-jetting period is a period from when jetting drive has once been executed to when jetting drive is next executed. During this non jetting period, moisture evaporates from ink in the nozzle 46, and thickening of the ink progresses. Accordingly, the drive data generating circuit 152, in the case where the non-jetting period is a threshold value period or more, generates non-jetting drive data so that non-jetting drive will be performed in at least some of the jetting cycles during this non-jetting period.

Then, the drive data generating circuit 152 generates the above-described drive data, based on the generated non-jetting drive data and jetting drive data, and outputs the drive data to the selection data generating circuit 153. The selection data generating circuit 153 generates the waveform selection data for selecting one from the 11 kinds of pulse waveforms, in each jetting cycle, for each of the piezoelectric elements 95, based on the drive data generated by the drive data generating circuit 152. At this time, the waveform selection data is generated so that when, in a certain jetting cycle, a meniscus vibration signal is output to a piezoelectric element 95 of a certain ink color, the kind of meniscus vibration signal set for said certain piezoelectric element 95 by the non-jetting drive setting information 123 is output to the piezoelectric element 95.

Incidentally, when the ink cartridge 42K storing the black pigment ink is left standing still for a long time, a jetting defect of the black ink sometimes occurs in the head 5.

In the pigment ink, the pigment exists in a dispersed state in a solvent, and when left standing still for a long time, the pigment whose specific gravity is large settles in a bottom section of the ink cartridge 42. Therefore, when the ink cartridge 42K storing the black pigment ink is left standing still for a long time, the pigment settles in the bottom section of the ink cartridge 42K. As a result, the pigment concentration of the pigment ink locally rises and viscosity of the pigment ink also locally rises in the bottom section of the ink cartridge 42K. When this thickened pigment ink is supplied to in the nozzle 46K, viscosity of the ink in the nozzle 46K sometimes rises to a threshold value or more. In this case, a problem occurs that even supposing a jetting signal of a voltage level based on the normal voltage has been output in the above-described way to the piezoelectric element 95 corresponding to the black ink, a desired amount of the black ink is not jetted from the nozzle 46K or the black ink is not jetted at all from the nozzle 46K.

In contrast, the dye inks differ from the pigment ink in that their components hardly ever settle. Therefore, even supposing the ink cartridges 42Y, 42M, 42C storing these dye inks have been left standing still for a long time, viscosity never locally rises in the bottom sections of these ink cartridges 42Y, 42M, 42C. As a result, viscosities of the inks in the nozzles 46Y, 46M, 46C also hardly ever attain the above-described threshold value or more.

As stated above, when the ink cartridge 42K storing the black pigment ink is left standing still for a long time, a jetting defect of the black ink sometimes occurs in the head 5. Accordingly, in the present embodiment, the CPU 101, after having received the printing instruction and before executing the print processing, executes an inside-of-nozzle viscosity estimation processing that estimates viscosity of the ink in the nozzle 46K. Then, when viscosity of the ink in the nozzle 46K estimated by the inside-of-nozzle viscosity estimation processing is a threshold value or more, the CPU 101 executes a voltage generation processing that causes the power supply circuit 60 to output a high voltage which is higher than the normal voltage. Specifically, the higher the estimated viscosity of the ink in the nozzle 46K is, the higher a voltage value is set. Therefore, the voltage level of the jetting signal output to the piezoelectric element 95K rises, whereby energy imparted to the ink in the nozzle 46K rises. As a result, it becomes possible for the desired amount of black ink to be jetted from the nozzle 46K.

Incidentally, although settling of the pigment may occur also in the ink channel 30K, such as in the sub-tank 14K, a settling amount of that settling is extremely small compared to in the ink cartridge 42K. Therefore, viscosity rise due to settling of the pigment mainly occurs inside the ink cartridge 42K. Accordingly, in the present embodiment, the CPU 101 first executes an inside-of-cartridge viscosity estimation processing in the inside-of-nozzle viscosity estimation processing in order to increase estimation accuracy. In the inside-of-cartridge viscosity estimation processing, viscosity of the ink in a lower section of the storage chamber 44 in the ink cartridge 42K, that is, viscosity of the ink in a connecting portion with the discharge tube 45 (hereafter, discharge tube connecting portion) inside the storage chamber 44, is estimated. Then, the viscosity of the ink in this discharge tube connecting portion estimated by the inside-of-cartridge viscosity estimation processing is employed to estimate viscosity of the ink in the nozzle 46K. The inside-of-cartridge viscosity estimation processing will be described below.

The longer a period the ink cartridge 42K has been left standing still is, the larger the settling amount of the pigment settling inside said ink cartridge 42K will become. Moreover, the smaller a frequency of supply of ink to inside the ink channel 30 from inside the ink cartridge 42K is, the larger the settling amount of the pigment settling inside the ink cartridge 42K will become. In addition, the higher a temperature inside the ink cartridge 42 is, the lower viscosity of the pigment ink will become, hence the more settling of the pigment will be promoted.

Accordingly, as depicted in FIG. 2, cartridge information 121K of the nonvolatile memory 104 includes total supplied amount count information 131, elapsed time information 132, and temperature history information 133.

The total supplied amount count information 131 is count information indicating a supplied amount of ink supplied to the ink channel 30 from inside the ink cartridge 42K from an attachment detection time point when it has been detected by the attachment detecting sensor 71 that the ink cartridge 42K has been attached to the cartridge attaching section 41K. The CPU 101 calculates a supplied amount of ink every time ink is supplied to the ink channel 30 from inside the ink cartridge 42K, on such occasions as print processing, flushing, and suction purge, and adds the supplied amount to a count value of the total supplied amount count information 131. Note that, in the present embodiment, the output voltage of the power supply circuit 60 is adjusted so that a droplet amount of ink jetted from the nozzle 46K when each of respective jetting signals is output one time to the piezoelectric element 95K will be substantially the same regardless of viscosity of the ink in the nozzle 46K. Therefore, the supplied amount of ink supplied at a time of print processing or flushing can be calculated by acquiring the number of times each kind of jetting signal has been output to the piezoelectric element 95K. Moreover, the supplied amount of ink supplied at a time of suction purge can be calculated from a rotational speed or drive time of the suction pump 51.

The elapsed time information 132 is information indicating an elapsed time from the above-described attachment detection time point, and, from the attachment detection time point onward, is successively updated by an internal clock of the controller 100. The temperature history information 133 is history information of the temperature measured by the temperature sensor 160 from the above-described attachment detection time point. Every time a fixed time is clocked by the internal clock, the CPU 101 adds to the temperature history information 133 the temperature measured by the temperature sensor 160 at that time.

In the inside-of-cartridge viscosity estimation processing, the CPU 101 estimates the settling amount of the pigment and thereby estimates viscosity of the ink in the discharge tube connecting portion inside the ink cartridge 42K, based on these total supplied amount count information 131, elapsed time information 132, and temperature history information 133. As a result, viscosity of the ink in the discharge tube connecting portion inside the ink cartridge 42K can be accurately estimated. Therefore, by using an estimation result of this inside-of-cartridge viscosity estimation processing, it is possible to accurately estimate viscosity of the ink in the nozzle 46K.

Incidentally, when the output voltage output by the power supply circuit 60 rises from the normal voltage to the high voltage, it results in the voltage level of the drive pulse signal output to the piezoelectric elements 95Y, 95M, 95C also rising. However, as touched on previously, viscosities of the inks in the nozzles 46Y, 46M, 46C that jet the dye inks, hardly ever attain the threshold value or more. Therefore, if, when the output voltage output by the power supply circuit 60 has risen from the normal voltage to the high voltage, the normal-use meniscus vibration signal (the meniscus vibration signal 4) is output to the piezoelectric elements 95Y 95M, 95C to perform the non-jetting drive processing, it results in a minimum jetting energy by which color ink is jetted from the nozzle 46 or more than that minimum jetting energy, being imparted to the inks inside the respective nozzles 46Y, 46M, 46C. As a result, the color inks are mistakenly jetted.

Accordingly, in the present embodiment, when the output voltage output by the power supply circuit 60 has been raised from the normal voltage to the high voltage, the meniscus vibration signal output to the piezoelectric elements 95Y, 95M, 95C has its setting changed to any one of the high voltage-oriented meniscus vibration signals 5-7 by which energy imparted to the ink in the nozzle 46 is smaller than by the meniscus vibration signal 4. Specifically, a meniscus vibration signal is set by which energy imparted to the inks in the nozzles 46Y, 46M, 46C will be less than the above-described minimum jetting energy. In more detail, a meniscus vibration signal is set by which energy imparted to the inks in the nozzles 46Y, 46M, 46C when output to the piezoelectric elements 95Y, 95M, 95C at a voltage level based on the high voltage will be the same as when the normal-use meniscus vibration signal 4 having a voltage level based on the normal voltage has been output to the piezoelectric elements 95Y, 95M, 95C. As a result, a meniscus vibration signal, of the meniscus vibration signals 5-7 is set by which the higher the voltage value of the output voltage output by the power supply circuit 60 is, the smaller the energy imparted to the ink in the nozzles 46Y, 46M, 46C will be. By setting in this way, a possibility of the color inks being mistakenly jetted can be reduced.

Moreover, as mentioned above, the present embodiment has as a print mode the second print mode where printing is performed using only the color inks without the black ink being used. In this second print mode, there is no need to jet black ink for image printing to the sheet S. Therefore, even when viscosity of the ink in the nozzle 46K is the threshold value or more, there is no need for the high voltage to be output by the power supply circuit 60. Accordingly, in the present embodiment, when performing printing by the second print mode, the output voltage output by the power supply circuit 60 is maintained at the normal voltage even when viscosity of the ink in the nozzle 46K is the threshold value or more. As a result, electric power consumption can be suppressed.

On the other hand, even during printing by this second print mode, there is a need for the meniscus vibration signal to be output to the piezoelectric element 95K with an object of suppressing thickening of the ink in the nozzle 46K. However, if viscosity of the ink in the nozzle 46K has thickened to the threshold value or more, then, even if the meniscus vibration signal 4 is output to the piezoelectric element 95K, agitation of the ink in the nozzle 46K cannot be sufficiently performed. Accordingly, when, even in the case where viscosity of the ink in the nozzle 46K is the threshold value or more, the output voltage output by the power supply circuit 60 is maintained at the normal voltage, the meniscus vibration signal output to the piezoelectric element 95K has its setting changed to any one of the high viscosity-oriented meniscus vibration signals 1-3 by which energy imparted to the ink in the nozzle 46 is larger than by the meniscus vibration signal 4. Specifically, a meniscus vibration signal, of the meniscus vibration signals 1-3 is set by which the higher the estimated viscosity of the ink in the nozzle 46K is, the larger the energy imparted to the ink in the nozzle 46 will be. As a result, thickening of the ink in the nozzle 46K can be suppressed.

(Operation of Ink-Jet Printer)

Figure 7A:
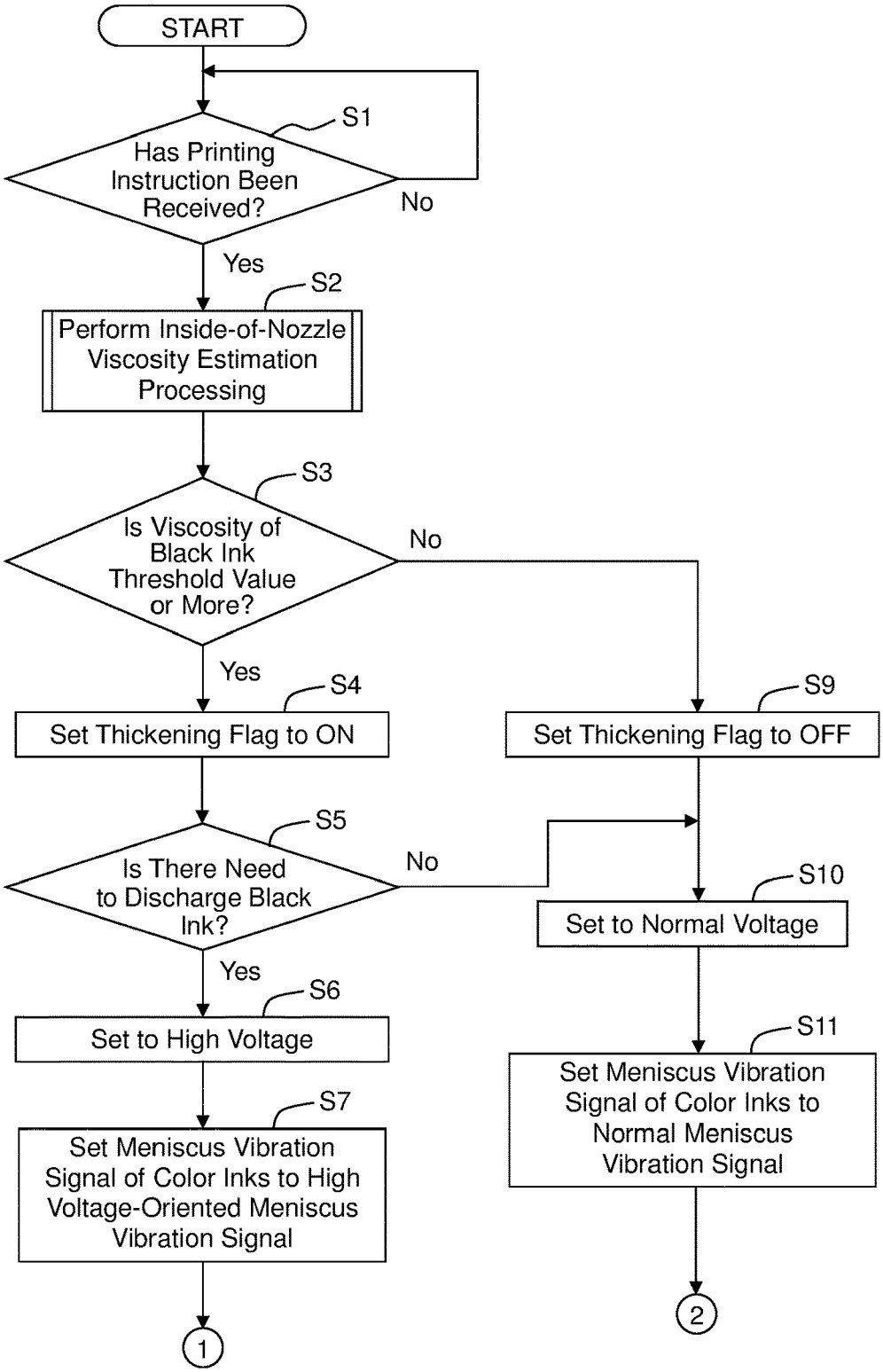
FIGS. 7A and 7B are flowcharts explaining a processing operation of the ink-jet printer.
Figure 7B:
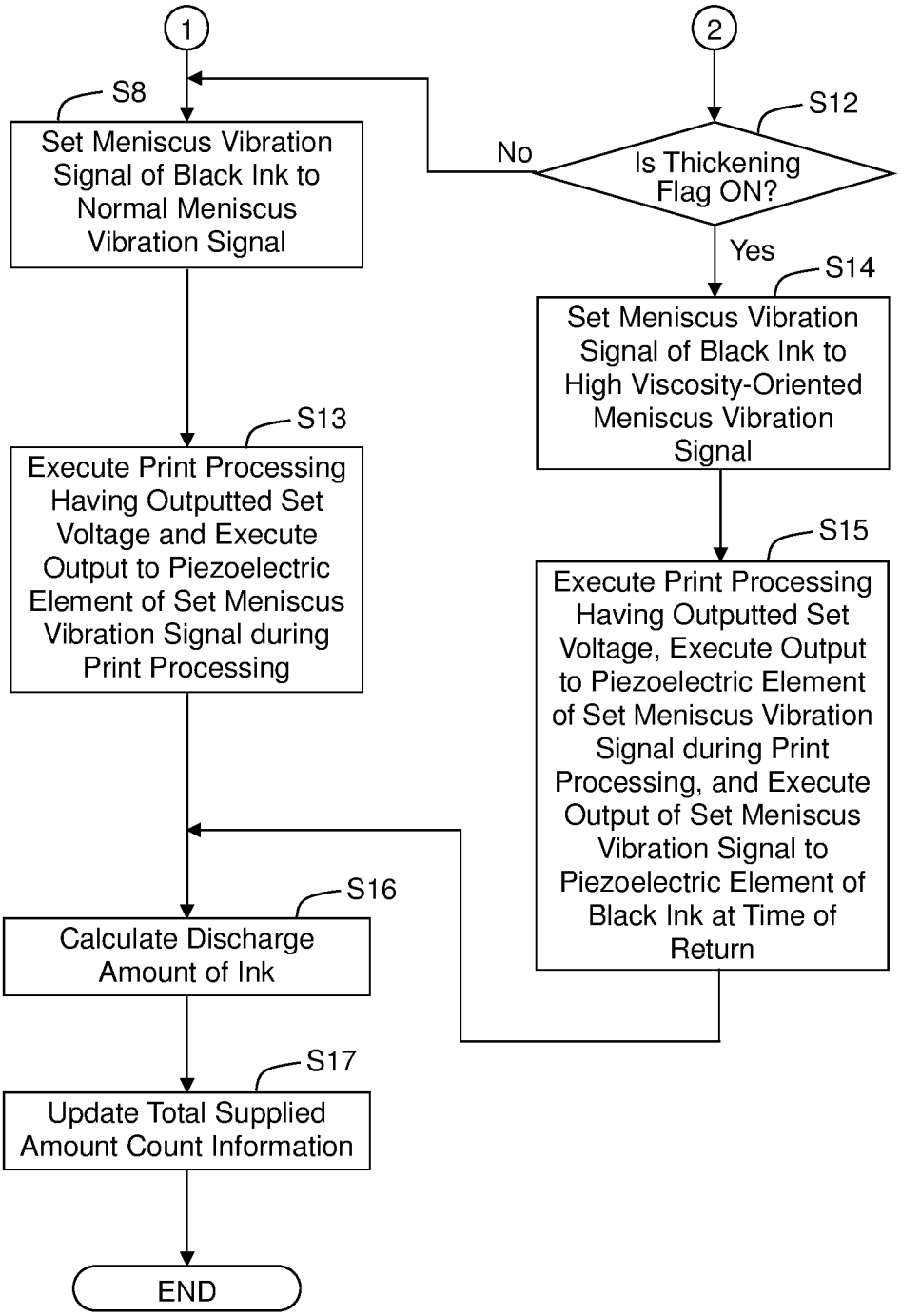

Next, one example of a processing operation of the printer 1 will be described with reference to FIG. 7.

The controller 100, upon executing a receiving processing in which the printing instruction is received from the external apparatus 31 (S1: YES), executes the inside-of-nozzle viscosity estimation processing (refer to FIG. 8) (S2). As a result of this inside-of-nozzle viscosity estimation processing, viscosity of the ink in the nozzle 46K is estimated. After this, the controller 100 judges whether the estimated viscosity of the ink in the nozzle 46K is the threshold value or more, or not (S3). In the case of the estimated viscosity having been judged to be the threshold value or more (S3: YES), the controller 100 sets a thickening flag 124 of the nonvolatile memory 104 to an ON state (S4). This thickening flag 124 is a flag that attains the ON state when viscosity of the ink in the nozzle 46K has been estimated to be the threshold value or more and an OFF state when it has been estimated to be less than the threshold value.

After step S4, the controller 100 executes a black ink jetting necessity judgment processing that judges whether there is a need to jet black ink from the nozzle 46K during print processing, or not (S5). Specifically, when the printing instruction is instructing execution of print processing in the above-described first print mode, there is judged to be a need to jet the black ink, and when the printing instruction is instructing execution of print processing in the second print mode, there is judged to be no need to jet the black ink.

In the case it has been judged there is a need to jet black ink during the print processing (S5: YES), the controller 100 sets the output voltage output by the power supply circuit 60 to a high voltage higher than the normal voltage, and stores the voltage value of that set high voltage in the nonvolatile memory 104, as voltage setting information 122 (S6). Note that at this time, the higher the viscosity of the ink in the nozzle 46K estimated by S2 is, the higher the voltage value is set. After this, the controller 100 sets the meniscus vibration signal to be output to the piezoelectric elements 95Y, 95M, 95C corresponding to the color inks to any one of the high voltage-oriented meniscus vibration signals 5-7, based on a voltage value of the voltage setting information 122, and stores that setting in the non-jetting drive setting information 123 of the nonvolatile memory 104 (S7). Specifically, a meniscus vibration signal, of the meniscus vibration signals 5-7 is set by which the higher the voltage value of the voltage setting information 122 is, the smaller the energy imparted to the ink in the nozzle 46 will be.

After this, the controller 100 sets the meniscus vibration signal to be output to the piezoelectric element 95K corresponding to the black ink to the normal-use meniscus vibration signal 4, and stores that setting in the non-jetting drive setting information 123 (S8).

In the case it has been judged by step S3 that viscosity of the ink in the nozzle 46K is less than the threshold value (S3: NO), the controller 100 sets the thickening flag 124 to the OFF state (S9). After step S9 or in the case it has been judged by step S5 that there is no need to jet black ink during the print processing (S5: NO), the controller 100 sets the output voltage output by the power supply circuit 60 to the normal voltage, and stores the voltage value of that set normal voltage in the nonvolatile memory 104, as the voltage setting information 122 (S10). After this, the controller 100 sets the meniscus vibration signal to be output to the piezoelectric elements 95Y, 95M, 95C corresponding to the color inks to the meniscus vibration signal 4, and stores that setting in the non-jetting drive setting information 123 (S11). Next, the controller 100, in the case that the thickening flag 124 is not in the ON state (S12: NO), shifts to above-described step S8.

After step S8, the controller 100 causes the power supply circuit 60 to output an output voltage of the voltage value set in the voltage setting information 123. Furthermore, the controller 100 executes print processing that while moving the carriage 3 to the left by driving the carriage drive motor 20, causes each of the piezoelectric elements 95 to perform jetting drive and thereby causes ink to be jetted from the nozzles 46, based on the printing data received from the external apparatus 31. Furthermore, the controller 100 executes the non-jetting drive processing that causes the piezoelectric elements 95 of each ink color to perform non-jetting drive, during this print processing (S13). Note that the kind of meniscus vibration signal output to the piezoelectric elements 95 of each ink color at a time of the non-jetting drive processing is set according to the non-jetting drive setting information 123. Moreover, this non-jetting drive processing is not performed at a return time when the carriage 3 is moved to the right.

On the other hand, in the case that, in step S12, the thickening flag 124 is in the ON state (S12: YES), the controller 100 sets the meniscus vibration signal to be output to the piezoelectric element 95K corresponding to the black ink to any one of the high viscosity-oriented meniscus vibration signals 1-3, and stores that setting in the non-jetting drive setting information 123 (S14). Specifically, a meniscus vibration signal, of the meniscus vibration signals 1-3 is set by which the higher the viscosity of the ink in the nozzle 46K estimated by the viscosity estimation processing of step S2 is, the larger the energy imparted to the ink in the nozzle 46 will be.

After step S14, the controller 100 executes the above-described print processing and executes the non-jetting drive processing that causes each of the piezoelectric elements 95 to perform non-jetting drive, during this print processing (S15). Note that the kind of meniscus vibration signal output to the piezoelectric elements 95 of each ink color at a time of the non-jetting drive is set according to the non-jetting drive setting information 123. Moreover, the non-jetting drive processing of the piezoelectric element 95K corresponding to the black ink is performed even at a return time when the carriage 3 is moved to the right. As a result, thickening of the ink in the nozzle 46K can be reliably suppressed. As a modified mode, the non-jetting drive of the piezoelectric element 95K may be performed only at the return time when the carriage 3 is moved to the right, provided that thickening of the ink in the nozzle 46K can be sufficiently suppressed by the non jetting drive of the piezoelectric element 95K executed while the carriage 3 is moved to the left.

Step S6 or step S10 and step S13 or step S15 correspond to a "voltage generation processing". In other words, a processing that stores the voltage setting information 123 in the nonvolatile memory 104 and a processing that causes the power supply circuit 60 to output an output voltage of the voltage value set in the voltage setting information 123, correspond to the "voltage generation processing". In addition, step S7 or step S11 and step S13 or step S15 correspond to a "second ink-oriented signal output processing". In other words, a processing that sets the meniscus vibration signal to be output to the piezoelectric elements 95Y, 95M, 95C corresponding to the color inks and a processing that outputs the set meniscus vibration signal to the piezoelectric elements 95Y, 95M, 95C, correspond to the "second ink-oriented signal output processing". Moreover, step S8 or step S14 and step S13 or step S15 correspond to a "first ink-oriented signal output processing". In other words, a processing that sets the meniscus vibration signal to be output to the piezoelectric element 95K corresponding to the black ink and a processing that outputs the set meniscus vibration signal to the piezoelectric element 95K, correspond to the "first ink-oriented signal output processing".

After the print processing of step S13 or step S15, the controller 100 calculates for each of the ink colors the ink jetting amount jetted during the print processing of step S13 or step S15 (S16). Then, each of the calculated ink jetting amounts is added to the count value of the total supplied amount count information 131 of each cartridge information 121 (S17), whereby the present processing is ended.

Figure 8A:
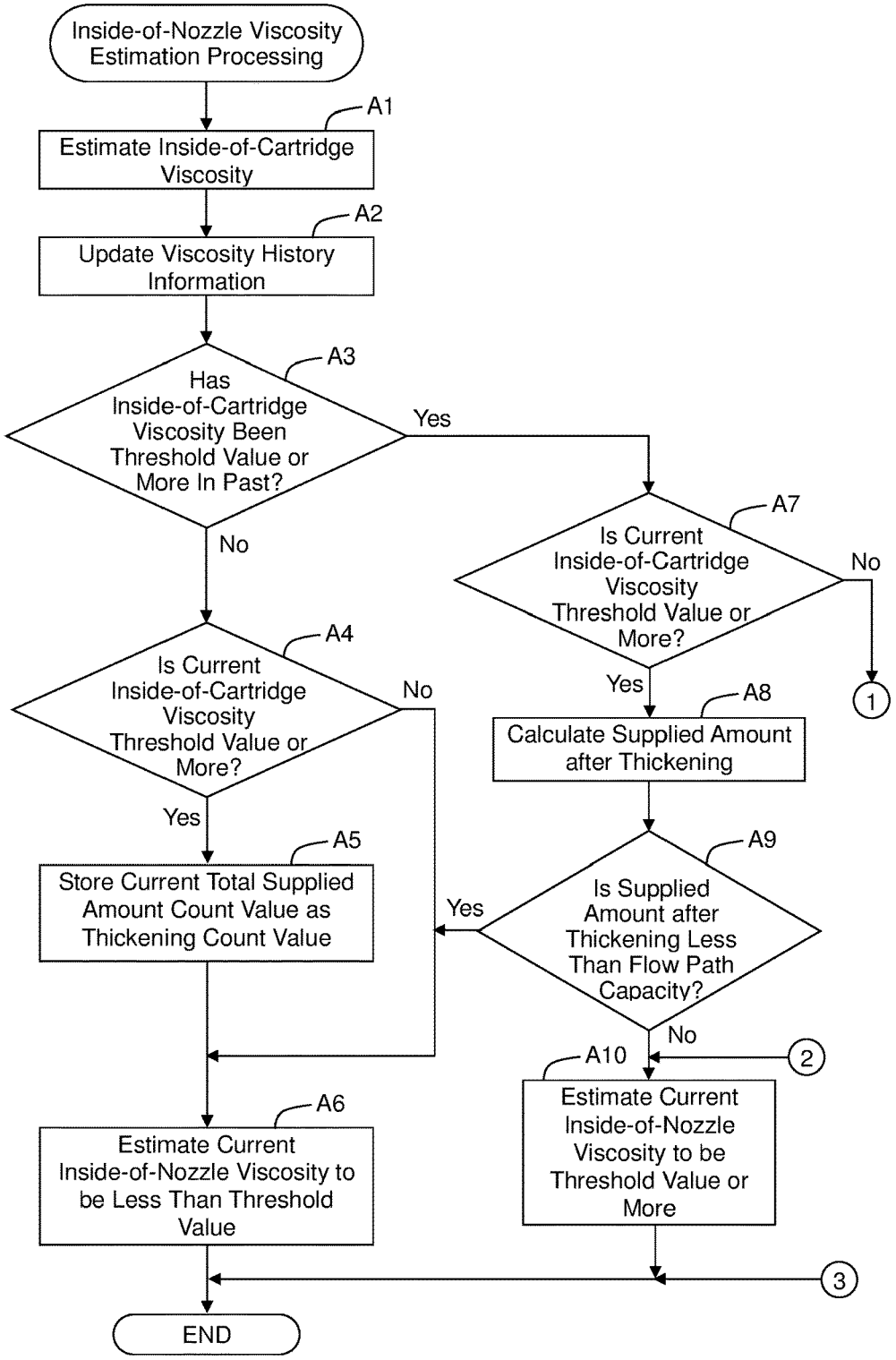
FIGS. 8A and 8B are flowcharts explaining inside-of-nozzle viscosity estimation processing.
Figure 8B:
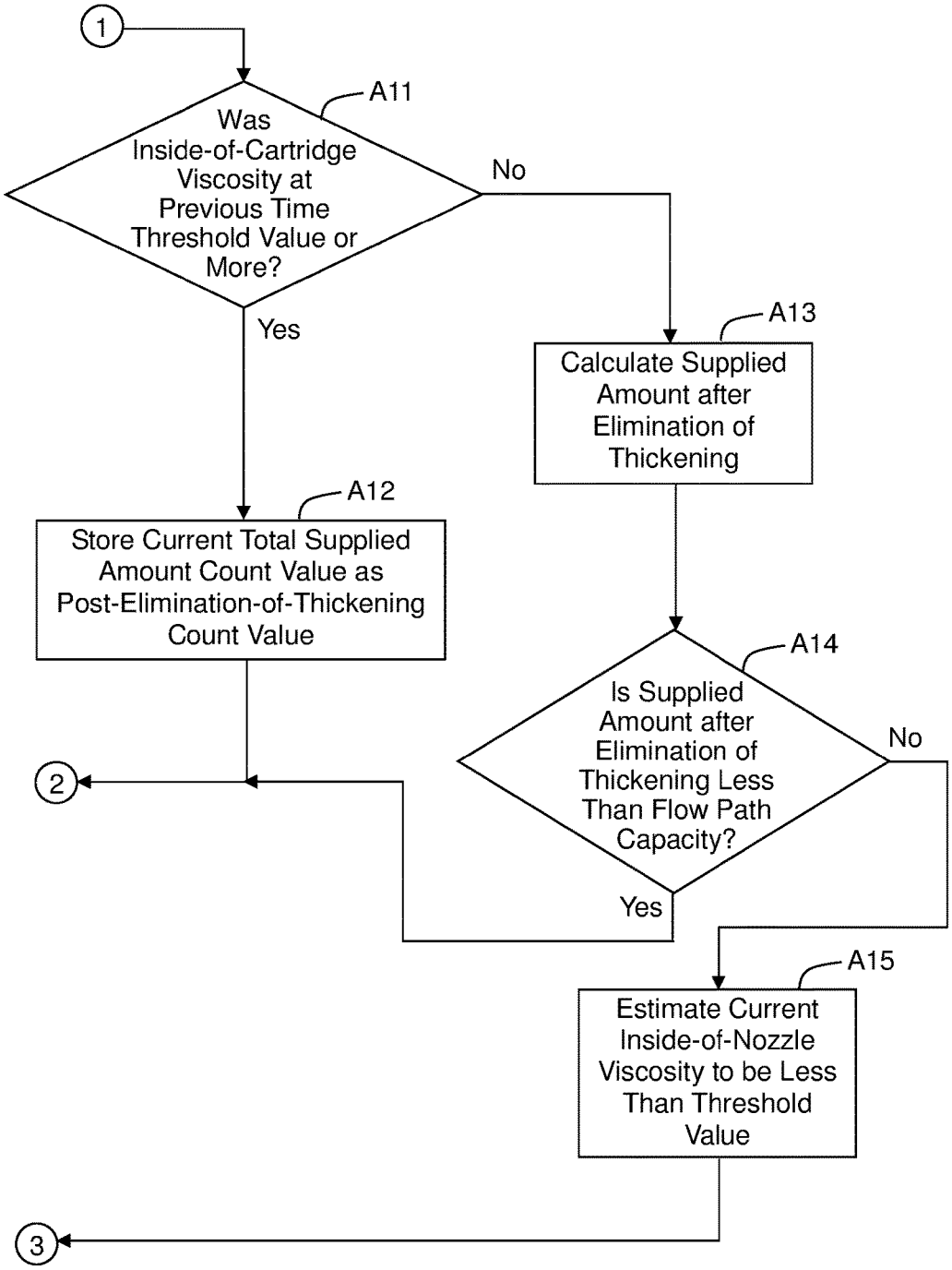

Next, the inside-of-nozzle viscosity estimation processing will be described with reference to FIG. 8.

First, the controller 100 executes the inside-of-cartridge viscosity estimation processing whereby current viscosity of the ink in the discharge tube connecting portion inside the ink cartridge 42K is estimated referring to the total supplied amount count information 131, the elapsed time information 132, and the temperature history information 133 (A1). After this, the controller 100 correlates the estimated current viscosity of the ink and the current count value of the total supplied amount count information 131 to store them anew in viscosity history information 134 of the cartridge information 121K of the nonvolatile memory 104, and thereby updates the viscosity history information 134 (A2). Note that the viscosity history information 134 is history information of viscosity of the ink in the discharge tube connecting portion that correlates viscosity of the ink in the discharge tube connecting portion inside the ink cartridge 42K and the count value of the total supplied amount count information 131.

Next, the controller 100 judges, with reference to the viscosity history information 134, whether viscosity of the ink in the discharge tube connecting portion inside the ink cartridge 42K has ever in the past been the threshold value or more, or not (A3). In the case that viscosity of the ink has been judged to have never in the past been the threshold value or more (A3: NO), the controller 100 judges whether the current viscosity of the ink estimated by the processing of A2 is the threshold value or more, or not (A4). In the case that the current viscosity of the ink has been judged to be the threshold value or more (A4: YES), the controller 100, assuming viscosity of the ink in the discharge tube connecting portion inside the ink cartridge 42K to have undergone transition from less than the threshold value to the threshold value or more, stores the current count value of the total supplied amount count information 131 in count information 135 of the cartridge information 121K, as a thickening count value (A5). After the processing of A5 or when it has been judged in the processing of A4 that the current viscosity of the ink is less than the threshold value (A4: NO), the controller 100 estimates viscosity of the ink in the nozzle 46K to be less than the threshold value (A6), whereby the present processing is ended.

In the case that in step A3, viscosity of the ink has been judged to have in the past been the threshold value or more (A3: YES), the controller 100 judges whether the current viscosity of the ink estimated by A2 is the threshold value or more, or not (A7). In the case that current viscosity of the ink has been judged to be the threshold value or more (A7: YES), the controller 100 calculates the supplied amount of ink supplied to the ink channel 30K from inside the ink cartridge 42K from when viscosity of the ink in the discharge tube connecting portion inside the ink cartridge 42K has undergone transition from less than the threshold value to the threshold value or more (from when viscosity of the ink has thickened) onward (A8). Specifically, an amount which is the thickening count value of the count information 135 subtracted from the current count value of the total supplied amount count information 131, is assumed to be a supplied amount after thickening. After this, the controller 100 judges whether the supplied amount after thickening is less than a channel capacity of the ink channel 30K, or not (A9). In the case that the supplied amount after thickening has been judged to be less than the flow capacity of the ink channel 30K (A9: YES), the controller 100, assuming thickened ink to have not yet reached in the nozzle 46, estimates viscosity of the ink in the nozzle 46K to be less than the threshold value (A6), and ends the present processing.

On the other hand, in the case that in step A9, the supplied amount after thickening has been judged to be the channel capacity of the ink channel 30K or more (A9: NO), the controller 100, assuming thickened ink to have reached in the nozzle 46, estimates the viscosity of the ink in the nozzle 46K to be the threshold value or more, and estimates that viscosity (A10). Specifically, a viscosity correlated to the count value closest to a value which is the channel capacity of the ink channel 30K subtracted from the current count value of the total supplied amount count information 131 in the viscosity history information 134, is estimated as the viscosity of the ink in the nozzle 46K. When step A10 ends, the present processing is ended.

In the case that in step A7, current viscosity of the ink in the discharge tube connecting portion of the ink cartridge 42K estimated by A2 has been judged to be less than the threshold value (A7: NO), the controller 100 judges, with reference to the viscosity history information 134, whether viscosity of the ink in the discharge tube connecting portion of the ink cartridge 42K estimated by the previous time of inside-of-cartridge viscosity estimation processing is the threshold value or more, or not (A11). In the case that viscosity of ink on the previous time has been judged to be the threshold value or more (A11: YES), the controller 100, assuming viscosity of the ink in the discharge tube connecting portion of the ink cartridge 42K to have undergone transition from the threshold value or more to less than the threshold value, stores the current count value of the total supplied amount count information 131 in the count information 135, as a post-elimination-of-thickening count value (A12). After this, the controller 100 shifts to step A10, estimates viscosity of the ink in the nozzle 46K to be the threshold value or more, and estimates that viscosity, whereby the present processing is ended.

In the case that in step A11, viscosity of ink on the previous time has been judged to be less than the threshold value (A11: NO), the controller 100 calculates the supplied amount of ink supplied to the ink channel 30K from inside the ink cartridge 42K after viscosity of the ink in the discharge tube connecting portion inside the ink cartridge 42K has undergone transition from the threshold value or more to less than the threshold value, in other words, after thickening has been eliminated (A13). Specifically, an amount which is the post-elimination-of-thickening count value of the count information 135 subtracted from the current count value of the total supplied amount count information 131, is assumed to be the supplied amount after elimination of thickening. After this, the controller 100 judges whether the supplied amount after elimination of thickening is less than the channel capacity of the ink channel 30K, or not (A14). In the case that the supplied amount after elimination of thickening has been judged to be less than the channel capacity of the ink channel 30K (A14: YES), the controller 100 assumes thickened ink to be still remaining in the nozzle 46K, and shifts to step A10. Then, the controller 100 estimates viscosity of the ink in the nozzle 46K to be the threshold value or more, and estimates that viscosity, whereby the present processing is ended. On the other hand, in the case that the supplied amount after elimination of thickening has been judged to be the channel capacity of the ink channel 30K or more (A14: NO), the controller 100, assuming thickened ink inside the ink channel 30K to have all been jetted from the nozzle 46K, estimates viscosity of the ink in the nozzle 46K to be less than the threshold value (A15), and ends the present processing.

As described above, according to the present embodiment, when viscosity of the black ink in the nozzle 46K rises to the threshold value or more, the output voltage output by the power supply circuit 60 rises from the normal voltage to the high voltage. Therefore, it can be suppressed that, in the print processing, black ink becomes un-jetted due to thickening of the black ink. Moreover, at a time of the non-jetting drive processing in the case that the high voltage is output by the power supply circuit 60, any one of the meniscus vibration signals 5-7 by which energy imparted to the ink in the nozzles 46Y, 46M, 46C is smaller compared to by the normal-use meniscus vibration signal 4, is output to the piezoelectric elements 95Y, 95M, 95C. As a result, the possibility of the color inks being mistakenly jetted can be reduced.

In the embodiment described above, the nozzle 46K corresponds to a "first nozzle", and the nozzles 46Y, 46M, 46C correspond to a "second nozzle". The ink cartridge 42K corresponds to a "first ink tank", and the ink cartridges 42Y, 42M, 42C correspond to a "second ink tank". The black pigment ink corresponds to a "first ink", and the color dye inks correspond to a "second ink". The piezoelectric element 95K corresponds to a "first drive element", and the piezoelectric elements 95Y, 95M, 95C correspond to a "second drive element". The power supply circuit 60 corresponds to a "power supply". The non-jetting drive processing that outputs the meniscus vibration signal to the piezoelectric element 95K corresponds to a "first ink-oriented non-jetting drive processing". The non-jetting drive processing that outputs the meniscus vibration signal to the piezoelectric elements 95Y, 95M, 95C corresponds to a "second ink-oriented non-jetting drive processing". The normal-use meniscus vibration signal 4 corresponds to a "first meniscus vibration signal", and the meniscus vibration signals 5-7 correspond to a "second meniscus vibration signal". A combination of the controller 100 and the driver IC 90 corresponds to a "control section". The cartridge attaching section 41 corresponds to a "tank attaching section". The temperature sensor 160 corresponds to a "temperature measuring section". The discharge tube 45 corresponds to a "supply section". The black ink jetting necessity judgment processing (the processing of S5) corresponds to a "first ink jetting necessity judgment processing". The print processing corresponds to a "jetting processing", and the printing instruction corresponds to a "jetting instruction". The inside-of-cartridge viscosity estimation processing corresponds to an "inside-of-tank viscosity estimation processing".

Next, modified modes formed by adding a variety of modifications to the previously described embodiment, will be described. In the above-mentioned embodiment, the yellow, cyan, and magenta color inks were dye inks. However, they may be pigment inks. Now, black pigment ink is a pigment ink in which the pigment settles more easily compared to in yellow, cyan, and magenta color pigment inks. This is mainly due to the fact that pigment particles have a larger diameter and are heavier, and a contained amount of those pigment particles is larger for the black pigment ink than for the color pigment inks. Therefore, when each of the ink cartridges 42 is in a state of having been left standing still for a long time, a larger amount of the pigment settles in the bottom section, whereby viscosity also becomes higher for the ink cartridge 42K compared to for the ink cartridges 42Y, 42M, 42C. As a result, viscosity of the ink in the nozzle 46K more easily attains the threshold value or more, compared to that of the inks in the nozzles 46Y, 46M, 46C. Therefore, by estimating viscosity of the ink in the nozzle 46K and thereby adjusting the output voltage output from the power supply circuit 60 based on that estimation result, it can be suppressed that the black ink becomes un-jetted, even for this modified mode, in the same way as in the above-mentioned embodiment. Moreover, at a time of the non jetting drive processing in the case that the output voltage output by the power supply circuit 60 is the high voltage, any one of the meniscus vibration signals 5-7 by which energy imparted to the ink in the nozzles 46Y, 46M, 46C is smaller compared to by the normal-use meniscus vibration signal 4, is output to the piezoelectric elements 95Y, 95M, 95C, hence the possibility of the color inks being mistakenly jetted can be reduced.

Note that at this time, the kinds of meniscus vibration signals to be output to each of the piezoelectric elements 95Y, 95M, 95C may be changed among each other. For example, even among the color pigment inks, the magenta pigment ink is a pigment ink whose pigment settles more easily compared to those of the yellow and cyan pigment inks. Therefore, for example, during the non-jetting drive processing, if the meniscus vibration signal to be output to the piezoelectric element 95M is set to the meniscus vibration signal 5, then the meniscus vibration signals to be output to the piezoelectric elements 95Y, 95C may be set to the meniscus vibration signal 6 or 7.

Moreover, in the above-mentioned embodiment, the inside-of-nozzle viscosity estimation processing was an estimation processing that took account of sealing of the pigment inside the ink cartridge 42. However, it may be an estimation processing that takes account of moisture evaporation of the ink. Specifically, in a period when the ink resides inside the ink cartridge 42 and in a process of the ink inside the ink cartridge 42 moving to the nozzle 46, moisture of the ink evaporates with the passage of time. Evaporation amounts per unit time at this time differ from each other according to the kinds of inks. For example, since moisture contents of the dye inks differ according to their kind, evaporation amounts per unit time of the dye inks differ from each other. As a result, sometimes, due to evaporation of moisture, viscosity of the ink in the nozzle 46 for an ink color having a large evaporation amount per unit time rises more greatly than viscosity of the ink in the nozzle 46 for an ink color having a small evaporation amount per unit time. Therefore, when, for example, all the colors of black, yellow, cyan, and magenta are dye inks, the CPU 101 may estimate viscosity of the ink in the nozzle 46 for an ink color having a large evaporation amount per unit time based on the total supplied amount count information 131 or the elapsed time information 132. In this case, when viscosity of the ink in the nozzle 46 for the ink color having a large evaporation amount per unit time has attained the threshold value or more, the output voltage output from the power supply circuit 60 is raised to the high voltage. On the other hand, at a time of the non-jetting drive processing in the case that the output voltage output by the power supply circuit 60 is the high voltage, any one of the meniscus vibration signals 5-7 by which energy imparted to the ink in the nozzle 46 is smaller compared to by the normal-use meniscus vibration signal 4, is output to the piezoelectric element 95 corresponding to an ink color having a small evaporation amount per unit time, hence the possibility of the inks being mistakenly jetted can be reduced.

Figure 9A:
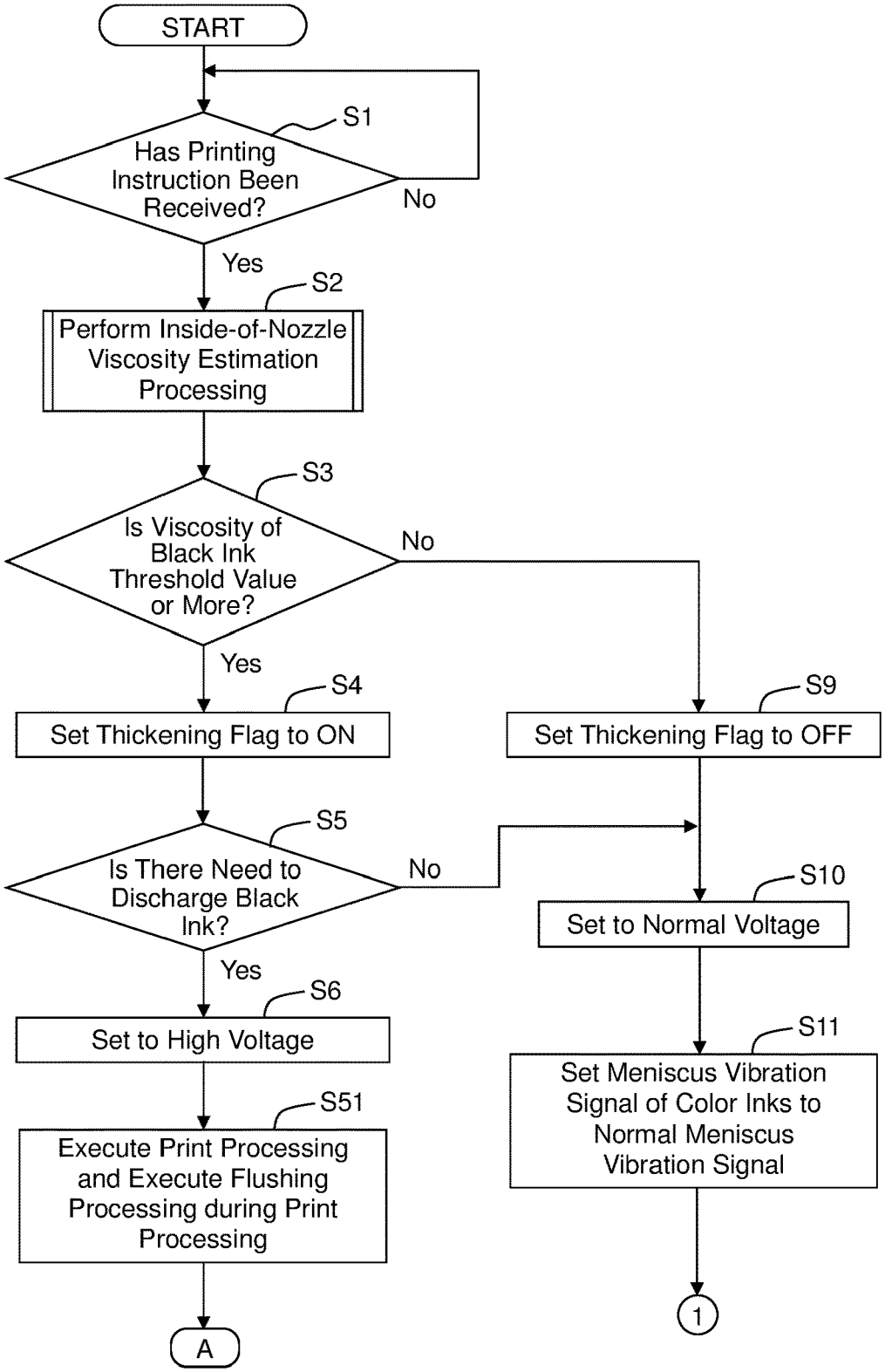
FIGS. 9A and 9B are flowcharts explaining a processing operation of the ink-jet printer according to a modified mode.
Figure 9B:
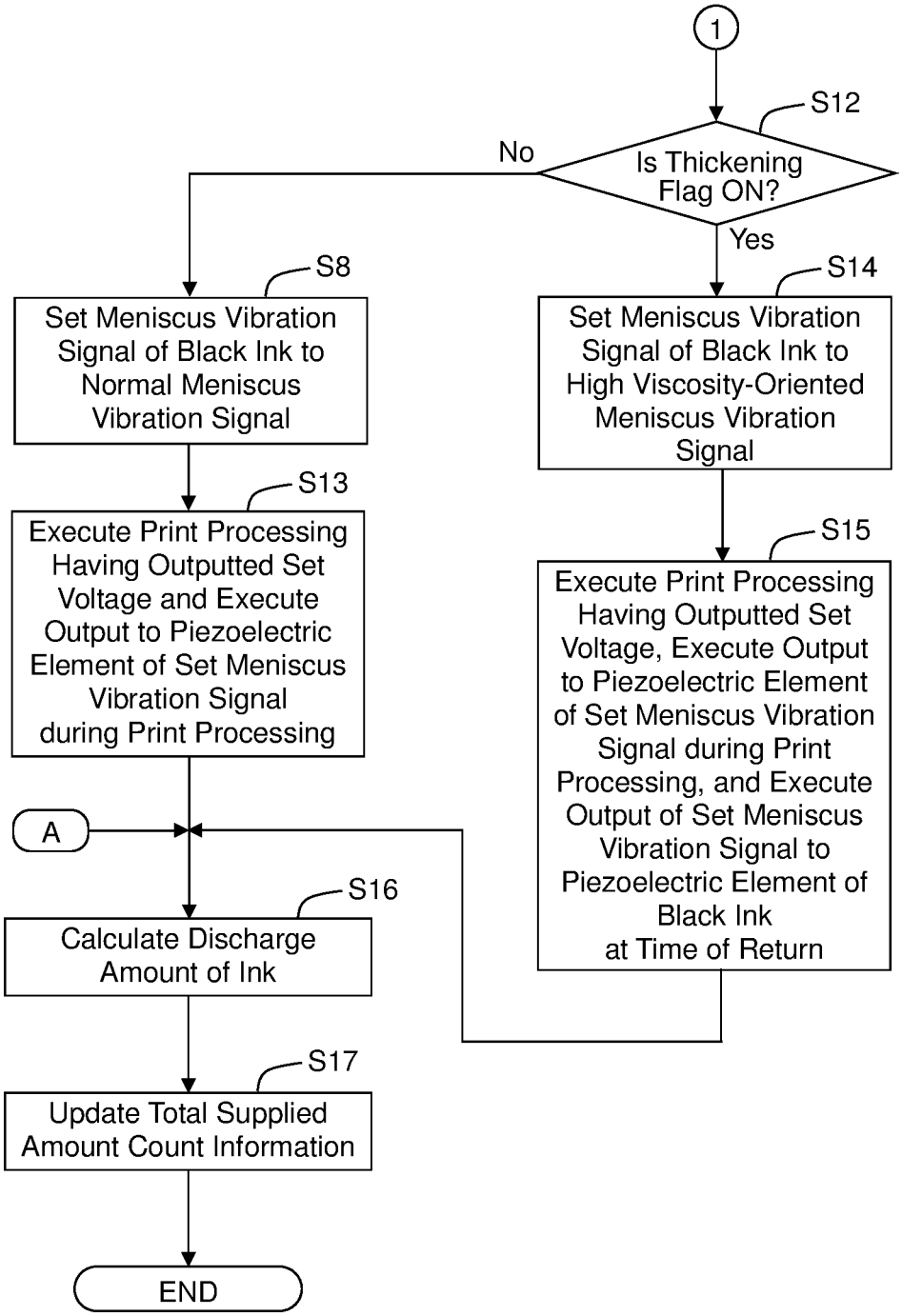

Next, another modified mode will be described. The above-mentioned embodiment was configured so that the non-jetting drive processing was performed during the print processing even when the output voltage output by the power supply circuit 60 had risen from the normal voltage to the high voltage. However, a configuration may be adopted whereby the non-jetting drive processing is not performed, and instead, the flushing processing is performed. In other words, the controller 100, in the case of having set the output voltage output by the power supply circuit 60 to the high voltage (in the case of having executed step S6), decides to perform the flushing processing, and in the case of having set the output voltage output by the power supply circuit 60 to the normal voltage (in the case of having executed step S10), decides to perform the non-jetting drive processing. Then, as depicted in FIG. 9, after the processing of S6, the controller 100 executes the above-described print processing, and, during this print processing, every time the carriage 3 has been caused to make a certain number of times of reciprocating movements, executes the flushing processing whereby in the facing state where the head 5 has been positioned in a position facing the flushing receiver 10, ink is jetted to the flushing receiver 10 by making each of the piezoelectric elements 95 perform jetting drive (S51). When this step S51 ends, the processing operation shifts to step S16.

Because, as stated above, in the present modified mode, the flushing processing is performed instead of the non-jetting drive processing in the print processing when the output voltage output by the power supply circuit 60 has risen from the normal voltage to the high voltage, it is possible, even in the present modified mode, to suppress mistaken jetting of ink while suppressing thickening of ink in the nozzle 46. In this modified mode, a mechanism for moving the head 5, that combines the carriage 3, the carriage drive motor 20, and so on, corresponds to a "moving mechanism". Note that in the present modified mode, the facing state of the head 5 and the flushing receiver 10 facing each other and the non-facing state of them not facing each other were switched by moving the head 5. However, it is possible for the flushing receiver 10 to be movable in the left-right direction and for the facing state and the non-facing state to be switched by moving the flushing receiver 10. Moreover, the facing state and the non-facing state may be switched by moving both of the head 5 and the flushing receiver 10.

Next, another modified mode will be described. In the above-mentioned embodiment, only viscosity of the ink in the nozzle 46K jetting black ink is estimated, and when that estimated viscosity has attained the threshold voltage or more, the output voltage output by the power supply circuit 60 is raised from the normal voltage to the high voltage. However, there is also a possibility that viscosities of the inks in the nozzles 46Y, 46M, 46C jetting the color inks also attain the threshold value or more, and there may also occur cases where these color inks cannot jet. In particular, viscosities of the inks in the nozzles 46Y 46M, 46C more easily rise when the color inks are pigment inks, compared to when the color inks are dye inks. Therefore, there may also be cases where, due to an attachment period to the cartridge attaching section 41 of each of the ink cartridges 42, viscosities of the inks in the nozzles 46Y, 46M, 46C become higher than the viscosity of the ink in the nozzle 46K. Accordingly, in the present modified mode, in the inside-of-nozzle viscosity estimation processing, viscosities of the inks inside each of the nozzles 46 are estimated. Then, when viscosity of the ink inside any one of the nozzles 46 is the threshold value or more, the output voltage output by the power supply circuit 60 is raised from the normal voltage to the high voltage. As a result, a situation of ink becoming unable to be jetted from the nozzle 46 due to thickening of the ink, can be suppressed for each of the ink colors.

Figure 10A:
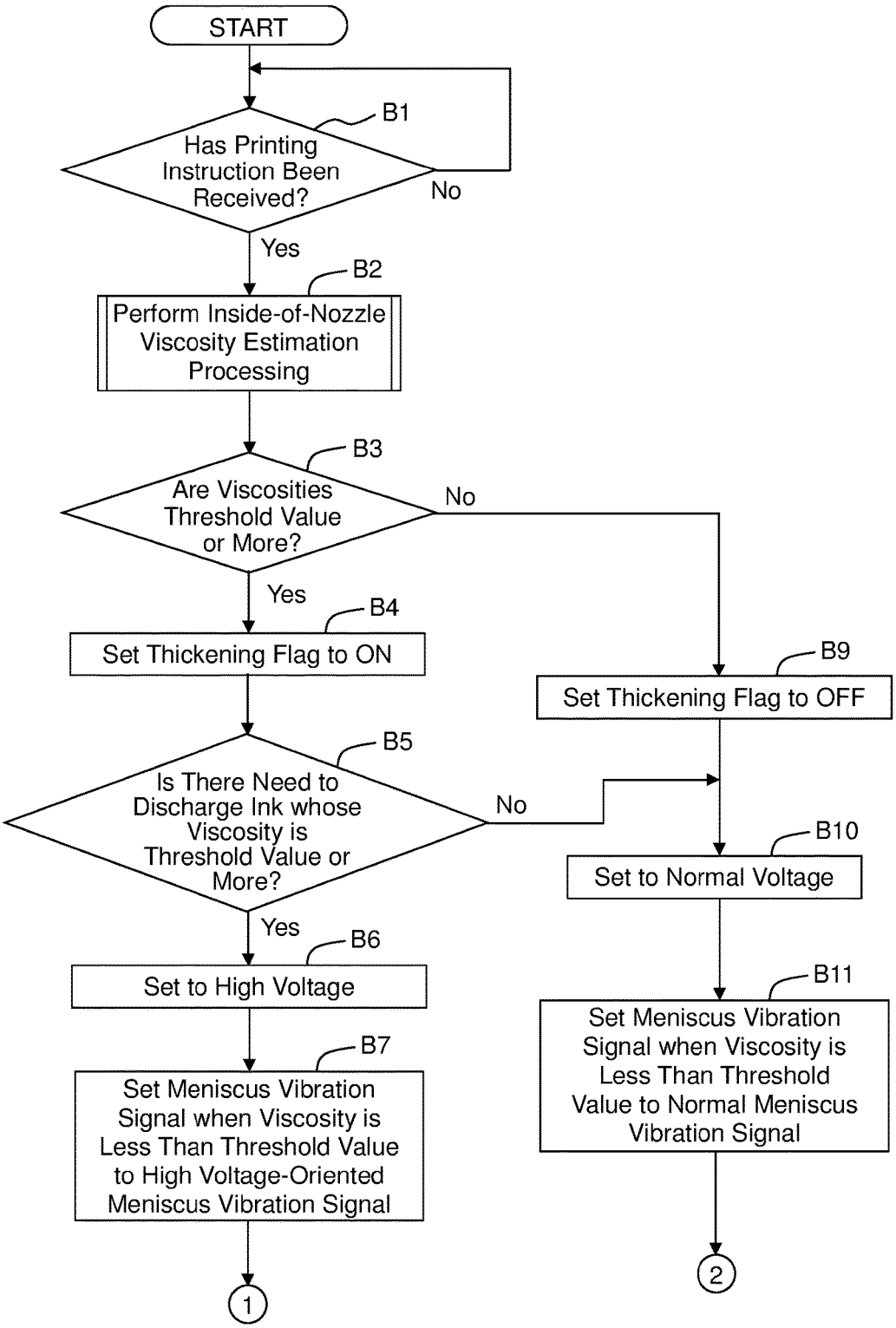
FIGS. 10A and 10B are flowcharts explaining a processing operation of the ink-jet printer according to a modified mode.
Figure 10B:
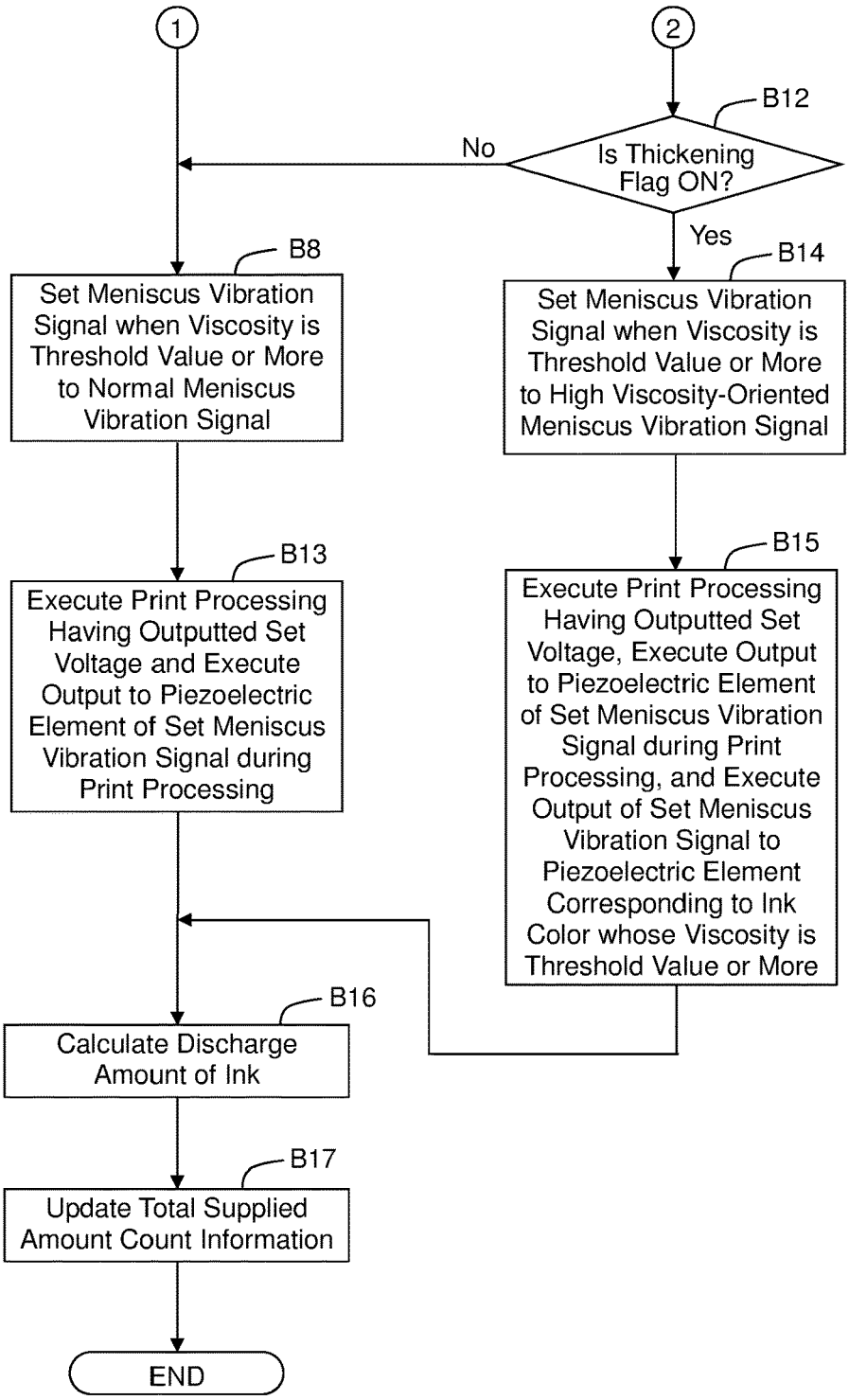

One example of a processing operation of the printer 1 of the present modified mode will be described below with reference to FIG. 10. Note that the total supplied amount count information 131, the elapsed time information 132, the temperature history information 133, the viscosity history information 134, and the count information 135 are stored in each cartridge information 121.

The controller 100, upon executing the receiving processing in which the printing instruction is received from the external apparatus 31 (B1: YES), executes for each of the ink colors the inside-of-nozzle viscosity estimation processing described with reference to FIG. 8 (B2). As a result of this inside-of-nozzle viscosity estimation processing, not only viscosity of the ink in the nozzle 46K, but also viscosities of the inks inside each of the nozzles 46Y, 46M, 46C are estimated. After this, the controller 100 judges whether the estimated viscosity of the ink inside any one of the nozzles 46 is the threshold value or more, or not (B3). In the case that viscosity of the ink inside any one of the nozzles 46 has been judged to be the threshold value or more (B3: YES), the controller 100 sets the thickening flag 124 to the ON state (B4), and after this, judges, based on the received printing instruction, whether there is a need to jet from the nozzle 46 the ink for which viscosity of the ink in the nozzle 46 is the threshold value or more, during print processing, or not (B5).

In the case it has been judged there is a need to jet the ink whose viscosity is the threshold value or more during the print processing (B5: YES), the controller 100 sets the output voltage output by the power supply circuit 60 to the highvoltage higher than the normal voltage, and stores the voltage value of that set high voltage in the nonvolatile memory 104, as the voltage setting information 122 (B6). After this, the controller 100 sets the meniscus vibration signal to be output to the piezoelectric element 95 corresponding to the ink color for which viscosity of the ink in the nozzle 46 has been estimated to be less than the threshold value to any one of the high voltage-oriented meniscus vibration signals 5-7, and stores that setting in the non-jetting drive setting information 123 (B7). Then, the controller 100 sets the meniscus vibration signal to be output to the piezoelectric element 95 corresponding to the ink color for which viscosity of the ink in the nozzle 46 has been estimated to be the threshold value or more to the normal-use meniscus vibration signal 4, and stores that setting in the non-jetting drive setting information 123 (B8). After step B8, step B13 which is similar to step S13 is executed.

In the case it has been judged by step B3 that viscosities of the inks inside all of the nozzles 46 are less than the threshold value (B3: NO), the controller 100 sets the thickening flag 124 to the OFF state (B9). After step B9 or in the case it has been judged by step B5 that there is no need to jet the ink whose viscosity is the threshold value or more during the print processing (B5: NO), the controller 100 sets the output voltage output by the power supply circuit 60 to the normal voltage, and stores the voltage value of that set normal voltage in the nonvolatile memory 104, as the voltage setting information 122 (B10). After this, the controller 100 sets the meniscus vibration signal to be output to the piezoelectric element 95 corresponding to the ink color for which viscosity of the ink in the nozzle 46 has been estimated to be less than the threshold value to the meniscus vibration signal 4, and stores that setting in the non jetting drive setting information 123 (B11). Next, the controller 100, in the case that the thickening flag 124 is not in the ON state (B12: NO), shifts to above-described step B8.

In the case that in step B12, the thickening flag 124 is in the ON state (B12: YES), the controller 100 sets the meniscus vibration signal to be output to the piezoelectric element 95 corresponding to the ink color for which viscosity of the ink in the nozzle 46 is the threshold value or more to any one of the high viscosity-oriented meniscus vibration signals 1-3, and stores that setting in the non jetting drive setting information 123 (B14). After step B14, step B15 which is similar to step S15 is executed.

Then, after step B13 or step B15, step B16 and step B17 which are similar to above-described step S16 and step S17 are executed, whereby the present processing is ended.

As stated above, according to the present modified mode, when viscosity of the ink inside a certain nozzle 46 rises to the threshold value or more, the output voltage output by the power supply circuit 60 rises from the normal voltage to the high voltage, hence, in the print processing, a situation of ink becoming unable to be jetted from said certain nozzle 46 due to thickening of the ink, can be suppressed. Moreover, at a time of the non-jetting drive processing in the case that the output voltage output by the power supply circuit 60 is the high voltage, any one of the high viscosity-oriented meniscus vibration signals 1-3 is output to the piezoelectric element 95 corresponding to the ink color for which viscosity of the ink in the nozzle 46 has been estimated to be less than the threshold value. As a result, the possibility of ink being mistakenly jetted can be reduced.

Other modified modes will be described below.

The inside-of-nozzle viscosity estimation processing need only be a processing that estimates viscosity of the ink present in a channel region at least including the nozzle 46K. Therefore, for example, the inside-of-nozzle viscosity estimation processing may be a processing that estimates viscosity of the ink present within a channel affecting ink jetting, such as a channel from the pressure chamber 83 to in the nozzle 46K.

The plurality of kinds of meniscus vibration signals need only be set so that energies imparted to the ink in the nozzle 46 when the respective meniscus vibration signals have been output to the piezoelectric element 95 at identical voltage levels differ from each other, and are not limited to those of the above-mentioned embodiment. For example, the plurality of kinds of meniscus vibration signals may differ from each other only in any one condition of the pulse width of the pulse P, the number of pulses P, and the pulse interval of a plurality of the pulses P included in one jetting cycle.

Moreover, the high voltage-oriented meniscus vibration signal, provided it satisfies a condition that energy imparted to the ink in the nozzle 46 when applied to the piezoelectric element at an identical voltage level is smaller than by the normal-use meniscus vibration signal, is not limited to that of the above-mentioned embodiment. For example, provided that the high voltage-oriented meniscus vibration signal has a pulse width of the pulse P which is shorter compared to that of the normal-use meniscus vibration signal, the number of pulses P of the high voltage-oriented meniscus vibration signal may be larger than the number of pulses P of the normal-use meniscus vibration signal in a range satisfying the above-described condition.

Even in the case that viscosity of the ink in the nozzle 46K had been estimated to be the threshold value or more, when the output voltage of the power supply circuit 60 was maintained at the normal voltage, the meniscus vibration signal to be output to the piezoelectric element 95K at a time of the non-jetting drive processing was set to any one of the high viscosity-oriented meniscus vibration signals 1-3. However, it may be set to the normal meniscus vibration signal 4. In this case, thickening of the ink in the nozzle 46K can be suppressed to a certain extent by having the non jetting drive of the piezoelectric element 95K performed also at the return time when the carriage 3 is moved to the right. Moreover, a configuration may be adopted whereby when viscosity of the ink in the nozzle 46K is the threshold value or more, the power supply circuit 60 is caused to output the high voltage, regardless of the print mode.

Moreover, in the above-mentioned embodiment, the waveform data storage circuit 151 stored pulse waveform data of eight kinds of meniscus vibration signals. However, it may store only pulse waveform data of the normal-use meniscus vibration signal 4 (hereafter, referred to as standard pulse waveform data BD). In this case, when the output voltage output by the voltage output circuit 63 has risen to the high voltage, the controller 100 generates, based on the standard pulse waveform data BD, pulse waveform data of the meniscus vibration signal to be output to the piezoelectric elements 95Y, 95M, 95C (hereafter, referred to as pulse waveform data CD), according to the voltage value of said high voltage. For example, by changing a pulse width Bt of the standard pulse waveform data BD, a pulse width Ct of the pulse waveform data CD is set based on the following Equation 1 when generating the pulse waveform data CD.

$$Ct=Bt\times\alpha\times V \quad \text{(Equation 1)}$$

Ct: pulse width of pulse waveform data CD
Bt: pulse width of pulse waveform data BD
α: voltage-pulse width sensitivity
V: voltage rise width Note that the voltage-pulse width sensitivity a indicates a correction rate of the pulse width with respect to a unit amount of voltage rise width for making the energy imparted to the inks in the nozzles 46Y, 46M, 46C the same as when the meniscus vibration signal 4 having a voltage level corresponding to the normal voltage has been output to the piezoelectric elements 95Y, 95M, 95C. Therefore, the larger the voltage rise width V is, the shorter the pulse width Ct will become compared to the pulse width Bt. By outputting to the driver IC 90 the generated pulse waveform data CD instead of the standard pulse waveform data BD in this way, the possibility of the color inks being mistakenly jetted can be more reliably suppressed.

The drive element imparting energy to the ink in the nozzle 46 was a piezoelectric element, but is not limited to this. For example, a heating element that causes film boiling by heating the ink, may be adopted as the drive element. Moreover, a power supply that generates a common voltage in the piezoelectric element 95 may be installed in the head 5. In the inside-of-cartridge viscosity estimation processing, the settling amount of the pigment was estimated whereby viscosity of the ink in the discharge tube connecting portion inside the ink cartridge 42K was estimated, based on the total supplied amount count information 131, the elapsed time information 132, and the temperature history information 133. However, they may be estimated based on only the total supplied amount count information 131 and the elapsed time information 132. Moreover, when a remaining amount of ink inside the ink cartridge 42 decreases, the settling amount of the pigment gets smaller. Therefore, whether viscosity of the ink in the discharge tube connecting portion inside the ink cartridge 42K has undergone transition from the threshold value or more to less than the threshold value, or not, may be estimated based on only the supplied amount of ink after thickening.

The cartridge attaching section to which the ink cartridge is attached may be applied also to a so-called on-carriage type printer where it is mounted on the carriage. The discharge tube 45 of the ink cartridge 42 need not be connected to the lower section of the storage chamber 44, but may be connected to a middle section of the storage chamber 44, for example.

Moreover, in the above-mentioned embodiment, the tank as a supply source of the ink was an ink cartridge. However, the tank is not limited to this, and may be, for example, a pouch-type ink storing bag configured from a resin having flexibility. This ink storing bag is provided with a cap to which the ink supply tube 22 can be connected, and when the ink supply tube 22 has been connected to this cap, the ink inside the ink storing bag is enabled to circulate into the ink supply tube 22. The inks stored in each of the ink cartridges 42 were of mutually differing ink colors. However, given that kinds (compositions) of said inks differ, they may be of the same ink color. Moreover, the non-jetting drive processing is not limited to being performed during the print processing, and may be performed before the print processing or after the print processing.

Moreover, the present disclosure may be applied also to a so-called line type ink-jet printer in which an image is printed on a sheet conveyed by a conveyance mechanism, in a state where the ink-jet head is fixed.

What is claimed is:

1. An ink-jet printer comprising:

an ink-jet head including:

a first nozzle configured to jet a first ink supplied from a first ink tank;

a second nozzle configured to jet a second ink supplied from a second ink tank, the second ink being different from the first ink;

a first drive element configured to impart energy to the first ink in the first nozzle; and a second drive element configured to impart energy to the second ink in the second nozzle;

a power supply configured to generate a common drive voltage to be applied to the first drive element and the second drive element; and a controller configured to execute:

generating a jetting signal and a plurality of kinds of meniscus vibration signals, the jetting signal being applied to the first and second drive elements to jet the first ink and the second ink from the first nozzle and the second nozzle, respectively, the jetting signal having a voltage level corresponding to the common drive voltage generated by the power supply, the plurality of kinds of meniscus vibration signals being applied to the first and second drive elements to vibrate a meniscus of the first ink in the first nozzles and a meniscus of the second ink in the second nozzles respectively without jetting the first and second inks, and the plurality of kinds of meniscus vibration signals having a voltage level corresponding to the common drive voltage generated by the power supply;

estimating a viscosity of the first ink in the first nozzle;

under a condition that the estimated viscosity of the first ink in the first nozzle is less than a threshold value, controlling the power supply to generate a first drive voltage;

under a condition that the estimated viscosity of the first ink in the first nozzle is equal to or greater than the threshold value, controlling the power supply to generate a second drive voltage being higher than the first drive voltage; and outputting one of the plurality of kinds of meniscus vibration signals to be applied to the second drive element to vibrate the meniscus of the second ink in the second nozzle, wherein at a time of applying to the second drive element to vibrate the meniscus of the second ink in the second nozzle, the controller is configured to:

output a first meniscus vibration signal of the plurality of kinds of meniscus vibration signals, in a case that the first drive voltage is generated by the power supply, and output a second meniscus vibration signal of the plurality of kinds of meniscus vibration signals, in a case that the second drive voltage is generated by the power supply, wherein energy imparted to the second ink, when the second meniscus vibration signal at a voltage level is applied to the second drive element, is smaller than energy imparted to the first ink when the first meniscus vibration signal at the voltage level is applied to the first drive element.

2. The ink-jet printer according to claim 1, wherein the controller is configured to execute outputting one of the plurality of kinds of meniscus vibration signals to be applied to the first drive element to vibrate a meniscus of the first ink in the first nozzle, and at a time of applying to the first drive element to vibrate the meniscus of the first ink in the first nozzle, the controller is configured to output a same kind of meniscus vibration signal of the plurality of kinds of meniscus vibration signals both when the first drive voltage is generated and when the second drive voltage is generated by the power supply.

3. The ink-jet printer according to claim 1, wherein in a case that the first meniscus vibration signal is applied to the second drive element at a voltage level corresponding to the second drive voltage, the second ink is jetted from the second nozzle, and in a case that the second meniscus vibration signal is applied to the second drive element at a voltage level corresponding to the second drive voltage, the second ink is not jetted from the second nozzle.

4. The ink-jet printer according to claim 1, wherein energy imparted to the second ink when the first meniscus vibration signal is applied to the second drive element at a voltage level corresponding to the first drive voltage is same as energy imparted to the second ink when the second meniscus vibration signal is applied to the second drive element at a voltage level corresponding to the second drive voltage.

5. The ink-jet printer according to claim 1, wherein the plurality of kinds of meniscus vibration signals are pulse signals, and a pulse width of the second meniscus vibration signal is shorter than a pulse width of the first meniscus vibration signal.

6. The ink-jet printer according to claim 1, wherein the plurality of kinds of meniscus vibration signals are pulse signals, each of the plurality of kinds of meniscus vibration signals has a plurality of pulses output to the second drive element at a time of the applying to the second drive element to vibrate the meniscus of the second ink in the second nozzle, and the second meniscus vibration signal has a number-of-pulses being fewer that of the first meniscus vibration signal.

7. The ink-jet printer according to claim 1, wherein the plurality of kinds of meniscus vibration signals are pulse signals, the first meniscus vibration signal and the second meniscus vibration signal both have a plurality of pulses output to the second drive element at a time of the applying to the second drive element to vibrate the meniscus of the second ink in the second nozzle, and a pulse interval of the plurality of pulses included in the first meniscus vibration signal differs from a pulse interval of the plurality of pulses included in the second meniscus vibration signal.

8. The ink-jet printer according to claim 1, wherein the controller is configured to execute:

applying the jetting signal to at least one of the first drive element and the second drive element to perform a printing, based on printing data;

receiving an instruction from outside, the instruction instructing execution of the printing; and judging whether to jet the first ink during execution of the printing, based on the received instruction, and under a condition that the controller has judged not to jet the first ink, the controller controls the power supply to generate the first drive voltage, even when the estimated viscosity of the first ink in the first nozzle is equal to or greater than the threshold value.

9. The ink jet printer according to claim 1, wherein the second meniscus vibration signal is one of a plurality of kinds of second meniscus vibration signals, and under a condition that the estimated viscosity of the first ink in the first nozzle is equal to or greater than the threshold value, the controller controls the power supply to generate the second drive voltage such that the higher the viscosity of the first ink in the first nozzle is, the higher the voltage becomes, and at a time of applying to the second drive element to vibrate the meniscus of the second ink in the second nozzle, the controller is configured to select and output the second meniscus vibration signal among the plurality of kinds of second meniscus vibration signals, the second meniscus vibration signal being selected such that the higher a voltage value of the second drive voltage is, the smaller energy imparted to the second ink by the second drive element is when applied to the second drive element at an identical voltage level.

10. The ink-jet printer according to claim 1, wherein the first ink is a pigment ink, and the second ink is a dye ink.

11. The ink-jet printer according to claim 1, further comprising:

a tank attaching section enabling the first ink tank to be attached; and a temperature sensor, wherein the first ink tank includes a storage chamber configured to store the first ink and a supply section connected to the storage chamber, the supply section configured to supply, to outside, the first ink in the storage chamber, and the controller is configured to:

acquire information of: a total amount of the first ink supplied from the first ink tank toward the ink-jet head from an attachment time point when the first ink tank has been attached to the tank attaching section, a measurement result of temperature due to the temperature sensor from the attachment time point, and an elapsed time from the attachment time point, based on the acquired information, estimate whether the viscosity of the first ink in a connecting portion with the supply section in the storage chamber of the first ink tank has changed from being less than the threshold value to being equal to or greater than the threshold value, due to settling of pigment in the first ink tank, and estimate the viscosity of the first ink in the first nozzle using the estimated viscosity of the first ink in the connecting portion.

12. The ink-jet printer according to claim 1, wherein the first ink and the second ink are both pigment inks, and the first ink is a pigment ink of which weight of a pigment particle is larger a contained amount of pigment particles is larger than those of the second ink.

13. An ink-jet printer comprising:

an ink-jet head including:

a first nozzle configured to jet a first ink supplied from a first ink tank;

a second nozzle configured to jet a second ink supplied from a second ink tank, the second ink being different from the first ink;

a first drive element configured to impart energy to the first ink in the first nozzle; and a second drive element configured to impart energy to the second ink in the second nozzle;

a power supply configured to generate a common drive voltage to be applied to the first drive element and the second drive element;

a liquid receiver configured to receive the second ink jetted from the second nozzle;

a moving mechanism configured to move at least one of the ink-jet head and the liquid receiver to a first position at which the second nozzle and the liquid receiver face each other and a second position at which the second nozzle and the liquid receiver do not face each other; and a controller configured to execute:

generating a jetting signal and a meniscus vibration signal, the jetting signal being applied to the first drive element and the second drive element to jet the first ink and the second ink from the first nozzle and the second nozzle, respectively, and having a voltage level corresponding to the common drive voltage generated by the power supply, the meniscus vibration signal being applied to the first drive element and the second drive element to vibrate a meniscus of the first ink in the first nozzle and a meniscus of the second ink in the second nozzle without jetting the first and second inks, and the meniscus vibration signal having a voltage level corresponding to the common drive voltage generated by the power supply;

estimating a viscosity of the first ink in the first nozzle;

under a condition that the estimated viscosity of the first ink in the first nozzle is less than a threshold value, controlling the power supply to generate a first drive voltage;

under a condition that the estimated viscosity of the first ink in the first nozzle is equal to or greater than the threshold value, controlling the power supply to generate a second drive voltage higher than the first drive voltage;

outputting the meniscus vibration signal to be applied to the second drive element to execute a non-jetting driving that vibrates the meniscus of the second ink in the second nozzle without jetting the second ink from the second nozzle;

moving at least one of the ink-jet head and the liquid receiver to the first position by the moving mechanism and outputting the jetting signal to the second drive element to perform a flushing; and in a case of recovering jetting performance of the second nozzle, determining which of outputting the meniscus vibration signal and the flushing is to be executed, wherein the controller determines to execute the flushing in a case that the second drive voltage is generated by the power supply.

14. An ink-jet printer comprising:

an ink-jet head including:

a plurality of nozzles corresponding to a plurality of ink tanks storing mutually differing kinds of inks, respectively; and a plurality of drive elements corresponding to the plurality of nozzles, respectively, and each of the plurality of drive elements configured to impart energy to ink in the corresponding nozzle;

a power supply configured to generate a common drive voltage to be applied to the plurality of drive elements; and a controller configured to execute:

generating a jetting signal and a plurality of kinds of meniscus vibration signals, the jetting signal being for jetting ink from the nozzle and having a voltage level corresponding to the common drive voltage generated by the power supply, the plurality of kinds of meniscus vibration signals being for vibrating a meniscus of ink in the nozzle without jetting the ink and, the plurality of kinds of meniscus vibration signals having a voltage level corresponding to the common drive voltage generated by the power supply;

estimating a viscosity of the ink in each of the plurality of nozzles;

under a condition that the estimated viscosity of the ink in all of the plurality of nozzles is less than a threshold value, controlling the power supply to generate a first drive voltage;

under a condition that the estimated viscosity of the ink in at least one nozzle of the plurality of nozzles is equal to or greater than the threshold value, controlling the power supply to generate a second drive voltage higher than the first drive voltage; and with respect to the drive element corresponding to a nozzle for which viscosity of ink in the nozzle has been estimated to be less than the threshold value, of the plurality of nozzles, outputting one of the plurality of kinds of meniscus vibration signals to execute vibrating a meniscus of the ink in the nozzle, wherein under a condition that the first drive voltage is generated by the power supply, the controller is configured to output a first meniscus vibration signal, of the plurality of kinds of meniscus vibration signals, and under a condition that the second drive voltage is generated by the power supply, the controller is configured to output a second meniscus vibration signal of the plurality of kinds of meniscus vibration signals, wherein energy imparted to the ink, when the second meniscus vibration signal at a voltage level is applied to the drive element, is smaller than energy imparted to the ink when the first meniscus vibration signal at the voltage level is applied to the drive element.

* * * * *